US005984705A

United States Patent [19]

Miyazaki et al.

[11] Patent Number: 5,984,705

[45] Date of Patent: Nov. 16, 1999

[54] CONNECTOR

[75] Inventors: Sho Miyazaki; Shuichi Kanagawa, both of Yokkaichi, Japan

[73] Assignee: Sumitomo Wiring Systems, Ltd., Japan

[21] Appl. No.: 08/982,241

[22] Filed: Dec. 1, 1997

[30] Foreign Application Priority Data

Dec. 2, 1996 [JP] Japan ..... 8-321878
Dec. 6, 1996 [JP] Japan ..... 8-327314

[51] Int. Cl.[6] ..... H01R 13/447

[52] U.S. Cl. ..... 439/304; 439/489; 439/188; 340/687

[58] Field of Search ..... 439/304, 489, 439/490, 188, 352, 353, 354; 340/687

[56] References Cited

U.S. PATENT DOCUMENTS

| | | | |
|---|---|---|---|
| 3,611,261 | 10/1971 | Gregory | 439/353 |
| 4,526,433 | 7/1985 | Tanaka | 439/304 |
| 4,615,575 | 10/1986 | Kossor | 439/304 |
| 4,647,726 | 3/1987 | Blum | 439/304 |
| 5,217,384 | 6/1993 | Merten et al. | 439/304 |
| 5,382,176 | 1/1995 | Norden | 439/357 |
| 5,435,748 | 7/1995 | Abe | 439/188 |
| 5,487,678 | 1/1996 | Tsuji et al. | 439/352 |
| 5,507,666 | 4/1996 | Yamanashi | 439/489 |
| 5,600,300 | 2/1997 | Povilaitis | 340/687 |
| 5,672,073 | 9/1997 | Matsumura et al. | 439/188 |
| 5,886,633 | 3/1999 | Adams | 340/568 |

FOREIGN PATENT DOCUMENTS 0 440 330 8/1991 European Pat. Off. .

*Primary Examiner*—Paula Bradley
*Assistant Examiner*—Tho D Ta
*Attorney, Agent, or Firm*—Anthony J. Casella; Gerald E. Hespos

[57] ABSTRACT

Connector housings are provided that are easily lockable, but hard to be unlocked. The housings include a male connector housing 10 with an elastic portion 14, and a female connector housing 20 with a receptacle 21 and a lock projection 24. While the connector housings 10, 20 are being engaged, the elastic portion 14 and the lock projection 24 are engaged with each other when the connector housings 10, 20 are properly engaged after the elastic portion 14 undergoes an elastic deformation. As a result, the connector housings 10, 20 are locked. In this state, the elastic portion 14 and the lock projection 24 are concealed inside the receptacle 21 and the unlocking cannot be performed by directly operating the elastic portion 14 by hand or finger. Accordingly, the connector housings 10, 20 are not inadvertently unlocked.

17 Claims, 19 Drawing Sheets

CONNECTOR

BACKGROUND OF THE INVENTION

1. Field of the Invention

The present invention relates to a connector provided with a locking means for locking a pair of connector housings in their engaged state.

2. Description of the Prior Art

A prior art connector with locking means for locking a pair of connector housings in an engaged state is shown in FIG. 20. In this connector, a female connector housing 1 is formed with an elastic portion 2, and a receptacle of a male connector housing 3 is formed with a lock hole 5. The elastic portion 2 undergoes an elastic deformation during engagement of the connector housings 1 and 3. Upon complete engagement, a projection 2A thereof is engaged with the lock hole 5. As a result, the connector housings 1 and 3 are locked so as to be disengageable from each other.

When the connector housings 1 and 3 are to be disengaged, an operable portion 2B formed on the elastic portion 2 is pushed by finger to deform the elastic portion 2. The deformed elastic portion 2 then is disengaged from the lock hole 5, and the connector housings 1 and 3 can be separated from each other. To improve operability in such a connector, the connector housings 1 and 3 can be locked only by being engaged with each other, and can be unlocked easily only by manually operating the operable portion 2B exposed from the receptacle.

For example, in an electric automotive vehicle, there are provided not only low voltage circuits of about 12 V, but also high voltage circuits of several 100 V. In these high voltage circuits, a connector construction for locking the connector housings in their engaged states is adopted as a means for connecting wires. However, since an easily unlockable construction is not desirable, there is a room for the improvement in the conventional locking mechanisms.

For a connector suitable for a high voltage circuit, a method may be considered which locks connector housings while fixing with a screw or a bolt after the connector housings are engaged. However, with such a locking means, the locking operation is very cumbersome.

The present invention was developed in view of the above problem and an object thereof is to provide a connector which can be easily locked, but cannot be easily unlocked.

SUMMARY OF THE INVENTION

According to the invention, there is provided a connector comprising at least one pair of connector housings that are substantially engageable with each other. A locking means is provided for locking the connector housings in their engaged state as the connector housings are substantially engaged. The locking means is provided in a position where it cannot be directly unlocked by hand or finger or without the use of an auxiliary tool, preferably a jig.

The locking means operates merely by engaging the pair of connector housings. Since the connector housings cannot be directly unlocked by hand or finger in their engaged state, they are not easily disengaged or disengageable from each other.

According to a preferred embodiment of the invention, at least one of the connector housings is provided with a cover for substantially covering the locking means such that the locking means cannot be directly unlocked by hand or finger or without the use of an auxiliary tool.

Preferably, the connector comprises a pair of connector housings engageable with each other. A locking means is provided for locking the connector housings in their engaged state as the connector housings are engaged. The connector housing is provided with a cover for covering the locking means such that the locking means cannot be directly unlocked by hand or finger.

The locking means functions merely by engaging the pair of connector housings. Since the locking means cannot be directly unlocked by hand or finger while being locked inside the cover, the pair of connector housings are not easily disengaged from each other.

Further preferably, an unlock detecting means is provided to electrically shut off electric circuits by detecting the unlocking of the connector housings. The locking means preferably is unlockable only by the operation of a jig and the unlock detecting means electrically shuts off the electric circuits by detecting the unlocking by the jig.

According to a further preferred embodiment, there is provided a connector comprising a pair of connector housings which are mounted each with a terminal fitting secured to a wire forming an electric circuit and are engaged to connect the terminal fittings with each other. A locking means is provided for locking the connector housings in their engaged state. The locking means is unlockable only by the operation of a jig and an unlock detecting means is provided to electrically shut off the electric circuit by detecting the unlocking by the jig.

The connector housings cannot be easily unlocked by hand or finger once they have been engaged and locked. Rather the unlocking is performed using the jig. The connector housings then are separated by pulling them away from each other. Before the terminal fittings are separated from each other, the unlocking by the jig is detected by the unlock detecting means and the electric circuits are electrically shut off. Thus, there is no likelihood of discharge between the terminal fittings, and high safety is ensured.

Preferably, the unlock detecting means comprises a switch element including at least one pair of detection fittings provided on the locking means and at least one short-circuiting fitting for short-circuiting the pair of detection fittings upon the unlocking of the connector housings. The at least one short-circuiting fitting preferably is provided on the jig for short-circuiting the pair of detection fittings upon the unlocking by the jig. In other words, the unlock detecting means preferably comprises a switch element including a pair of detection fittings provided on the locking means and a short-circuiting fitting provided on the jig for short-circuiting the pair of detection fittings upon the unlocking by the jig.

When the unlocking is performed by the jig, the short-circuiting fitting provided on the jig short-circuits the pair of detection fittings. Thus, the unlocking by the jig is detected and the electric circuits are electrically shut off.

Most preferably, the unlock detecting means comprises a switch element including at least one pair of detection fittings provided on the locking means of one connector housing and at least one short-circuiting fitting provided on the locking means of the other connector housing. The pair of detection fittings are short-circuited by the short-circuiting fittings in a locked state. Additionally the short-circuiting of the pair of detection fittings preferably is released by the unlocking by the jig.

When the unlocking is performed by the jig, the short-circuiting fitting is disengaged from the pair of detection fittings to release the short-circuited state. Thus, the unlocking by the jig is detected and the electric circuits are electrically shut off.

These and other objects, features and advantages of the present invention will become more apparent upon a reading of the following detailed description and accompanying drawings.

DETAILED DESCRIPTION OF THE PREFERRED EMBODIMENTS

Figure 1:
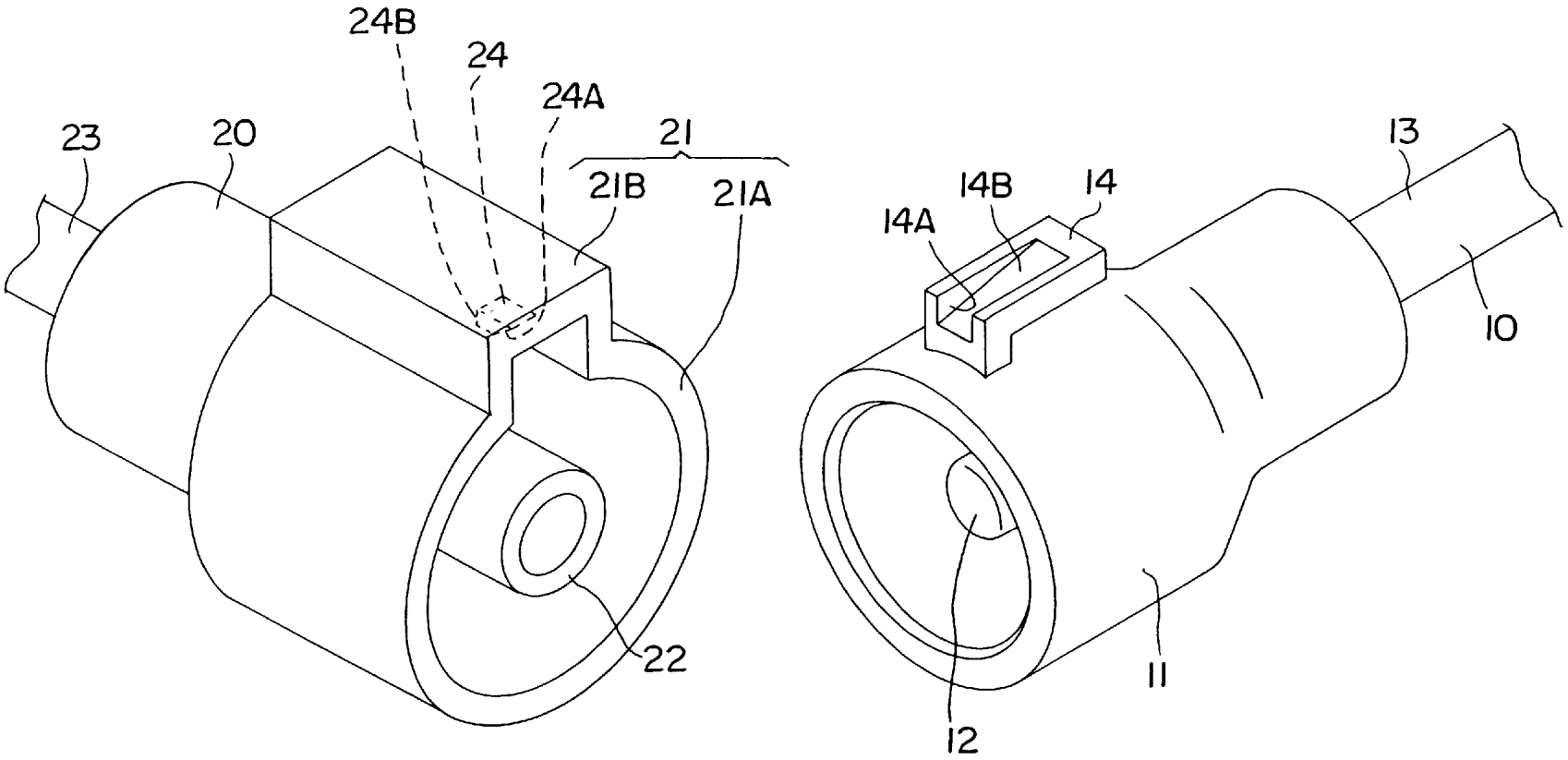
FIG. 1 is a perspective view of a first embodiment when both connector housings are separated from each other.
Figure 2:
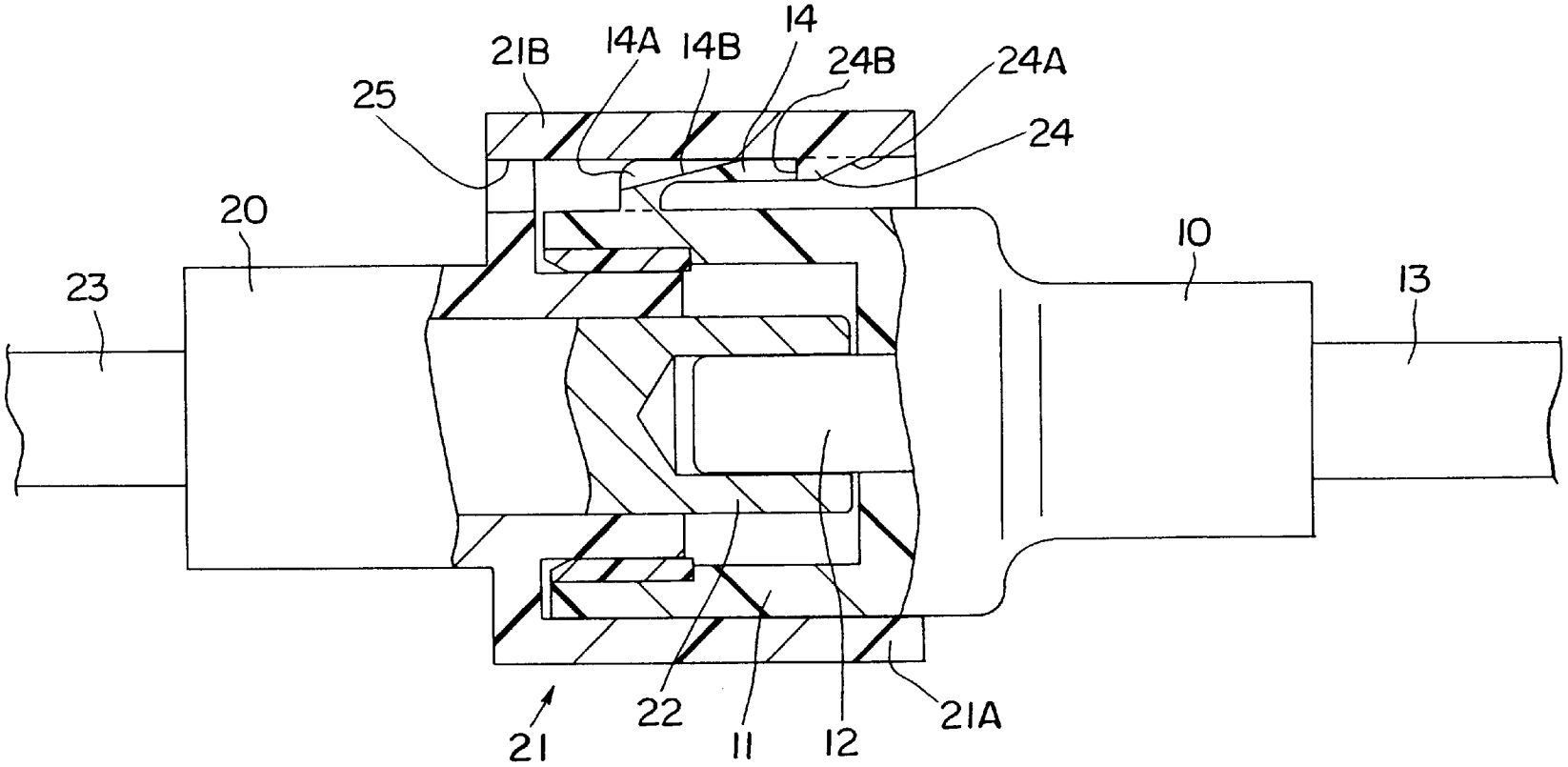
FIG. 2 is a section of the first embodiment when the connector housings are engaged to be locked with each other.
Figure 3:
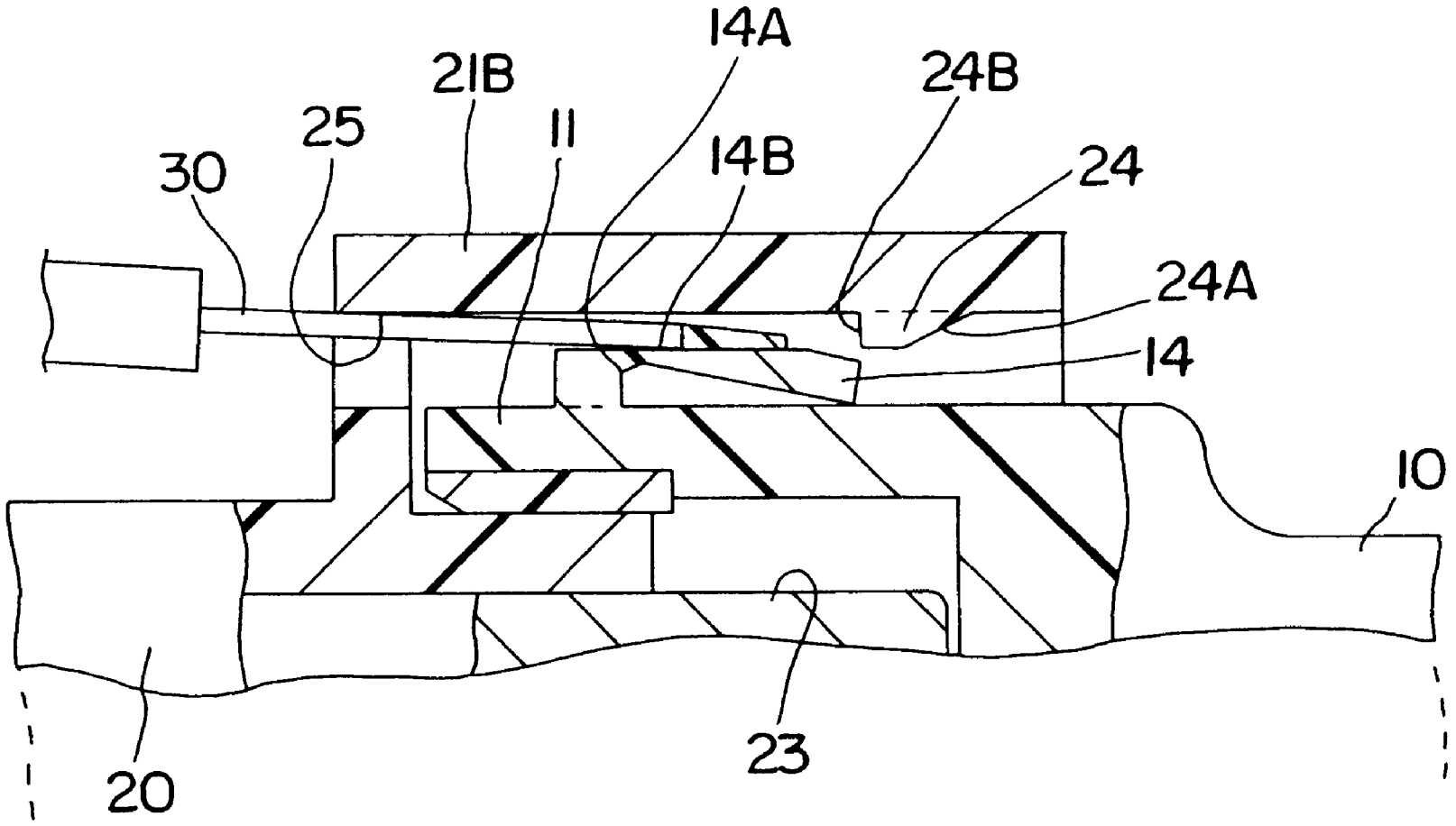
FIG. 3 is a partial section of the first embodiment in its unlocked state.

A connector according to a first embodiment is illustrated in FIGS. 1–3. This connector is provided with a male connector housing 10, a female connector housing 20 and a locking means for locking the connector housings 10 and 20 in their engaged state.

The male connector housing 10 includes a tubular engaging portion 11 projecting forward, and a substantially bar-shaped male terminal fitting 12 projecting inside the engaging portion 11. The male terminal fitting 12 is connected with a wire 13 which comes out through the rear end surface of the male connector housing 10. An elastic portion 14, which substantially constructs the locking means, is formed on the outer surface of the engaging portion 11 of the male connector housing 10. The elastic portion 14 is shaped such that it substantially axially extends, preferably upwardly from its fixed end in vicinity of a front end of the engaging portion 11, and is then bent so that its free end extends in the longitudinal direction, preferably in a direction of engagement of the male/female connector housings 10 and 20, e.g. backwardly. The elastic portion 14 is elastically deformable preferably in a substantially radial direction. In a middle portion or part of the elastic portion 14 with respect to its width direction is provided a jig insertion portion 14A formed e.g. by cutting away the upper surface over the front surface to form a downwardly sloped surface to the front. A jig 30 for disengaging the elastic portion 14 and a lock projection 24 is insertable or fittable into the jig insertion portion 14A as shown in FIG. 3.

The female connector housing 20 includes a tubular hood or receptacle 21 projecting forwardly. A tubular female terminal fitting 22 is engageable with the male terminal fitting 12 and projects inside the receptacle 21. The female terminal fitting 22 is connected with a wire 23 which comes out through the rear end surface of the female connector housing 20. The receptacle 21 substantially covers the engaging portion 11 and the elastic portion 14 at least when the male and female connector housings 10 and 20 are engaged. The receptacle 21 is comprised of an arcuate portion 21A which is so formed as to conform to the outer surface of the engaging portion 11 and a substantially box-shaped covering portion 21B in which the elastic portion 14 can be accommodated. A clearance between the covering portion 21B and the outer surface of the engaging portion 11 when the covering portion 21B covers the elastic portion 14 is set small e.g. such that a finger, not to mention a hand, cannot be inserted into this clearance.

On the ceiling surface of the covering portion 21B is formed the lock projection 24 which is inwardly projecting and engageable with the elastic portion 14 and substantially constructs the locking means. This lock projection 24 is comprised of a slanted surface 24A which faces the elastic portion 14 while the connector housings 10 and 20 are being engaged and a lock surface 24B which engages the leading end surface of the elastic portion 14 when the engagement of the connector housings 10 and 20 is completed. The lock projection 24 is located in a position where it can be aligned with the jig insertion portion 14A of the elastic portion 14 and has a narrower width than the jig insertion portion 14A. Accordingly, while the connector housings 10 and 20 are being engaged, the lock projection 24 enters the jig insertion portion 14A to face a slanted surface 14B.

In the rear end surface of the covering portion 21B is formed a mold withdrawal hole 25 used to withdraw a mold (not shown) for forming the lock projection 24. This hole 25 faces the jig insertion portion 14A of the elastic portion 14 when the connector housings 10 and 20 are locked. When the narrow jig 30 is inserted into the mold withdrawal hole 25, its leading end reaches the jig insertion portion 14A.

To engage the connector housings 10 and 20, the receptacle 21 is fitted substantially around the engaging portion 11, and the connector housings 10 and 20 are pressed or moved into each other while being positioned with respect to circumferential direction by a positioning means (not shown) constructed by, e.g. a projection and a groove or by forming the male and female connector housing 10 and 20 with a non-circular cross section. Then, the lock projection 24 enters the jig insertion portion 14A and comes into contact with the slanted surface 14B. Due to a pressing force acting on the slanted surface 14B, the elastic portion 14 undergoes such an elastic deformation as to move away from the lock projection 24. When the connector housings 10 and 20 are properly engaged, the lock projection 24 is disengaged from the upper surface of the elastic portion 14, which then is restored elastically substantially to its original position. As a result, as shown in FIG. 2, the lock surface 24B of the lock projection 24 and the leading end surface of the elastic portion 14 are locked. The connector housings 10 and 20 are locked in their engaged state by the engagement of the lock projection 24 and the elastic portion 14.

In this state, the engaged elastic portion 14 and lock projection 24 are concealed by the covering portion 21B. Since the inside of the covering portion 21B is narrow, an operator cannot directly touch the elastic portion 14 with his hand or finger. Accordingly, it is impossible for the operator to unlock the connector housings 10 and 20 by operating the elastic portion 14 with his hand or finger.

To unlock the connector housings 10 and 20, the jig 30 is inserted through the mold withdrawal hole 25 to come into contact with the slanted surface 14B of the jig insertion portion 14A, and is operated to lower the jig insertion portion 14A. Then, as shown in FIG. 3, the elastic portion 14 is deformed away from the lock projection 24 to unlock the connector housings 10 and 20. If the connector housings 10 and 20 are slightly moved away from each other in this state, the lock projection 24 comes into contact with the upper surface of the elastic portion 14. Thereafter, the jig 30 is withdrawn and the connector housings 10 and 20 are or can be separated from each other.

As described above, in this embodiment, the connector housings 10 and 20 are locked at once only by being engaged with each other, thereby improving operability. Further, since the connector housings 10 and 20 cannot be unlocked by hand or finger, an inadvertent disengagement thereof can be securely prevented.

Further, in this embodiment, since the unlocking is performed by the jig 30 taking advantage of the mold withdrawal hole 25 which is formed when the lock projection 24 is formed, the strength of the covering portion 21B is higher as compared to a case where a jig insertion hole separate from the mold withdrawal hole 25 is formed, e.g. in the upper surface of the covering portion 21B.

Furthermore, since the elastic portion 14 is formed with the cut-away portion (jig insertion portion 14A) and the lock projection 24 is formed with the slanted surface 24A, an excessive deformation of the elastic portion 14 while the connector housings 10 and 20 are being engaged and disengaged can be prevented.

Figure 4:
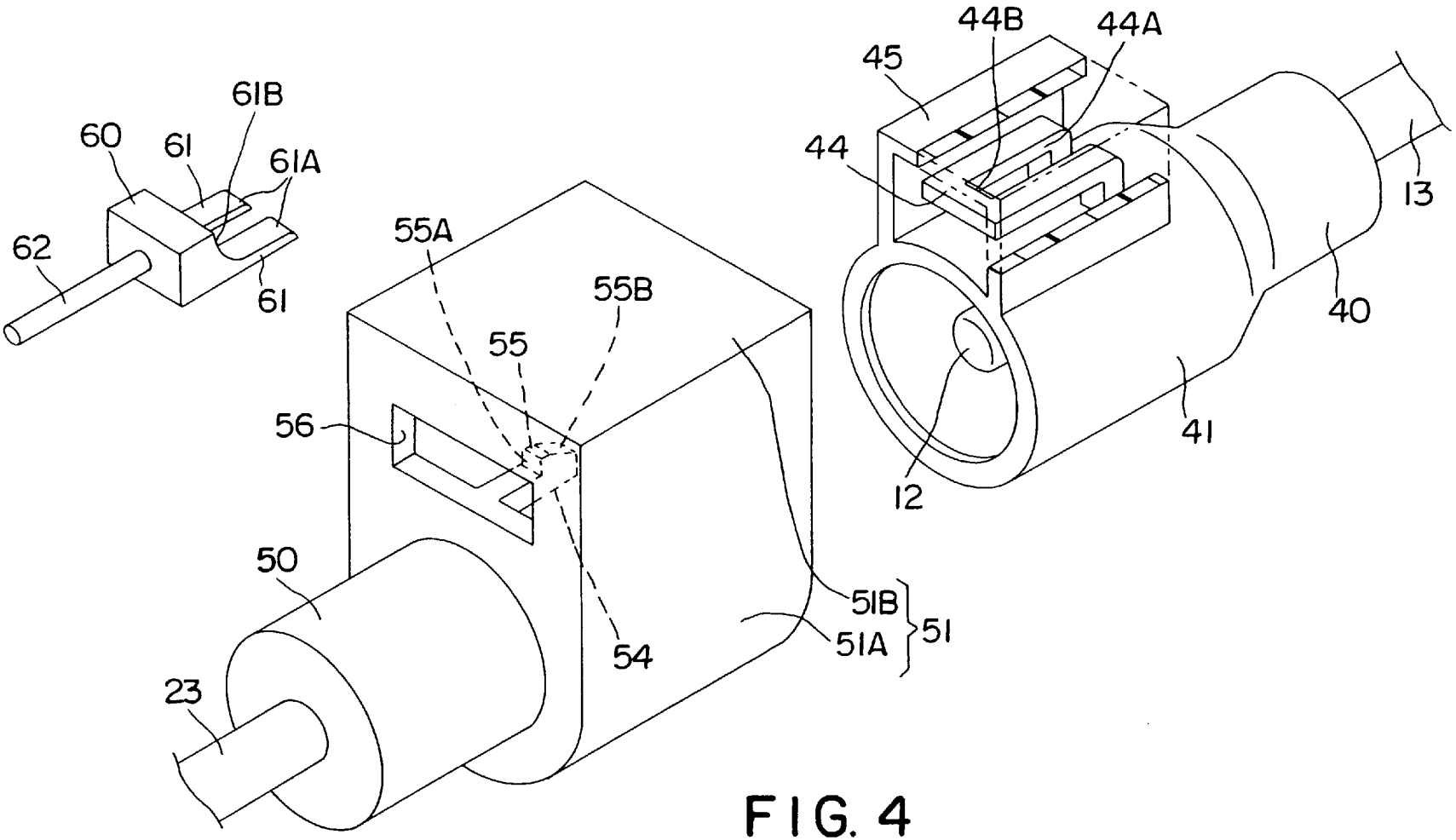
FIG. 4 is a perspective view partly in section of a second embodiment when both connector housings are separated from each other.
Figure 5:
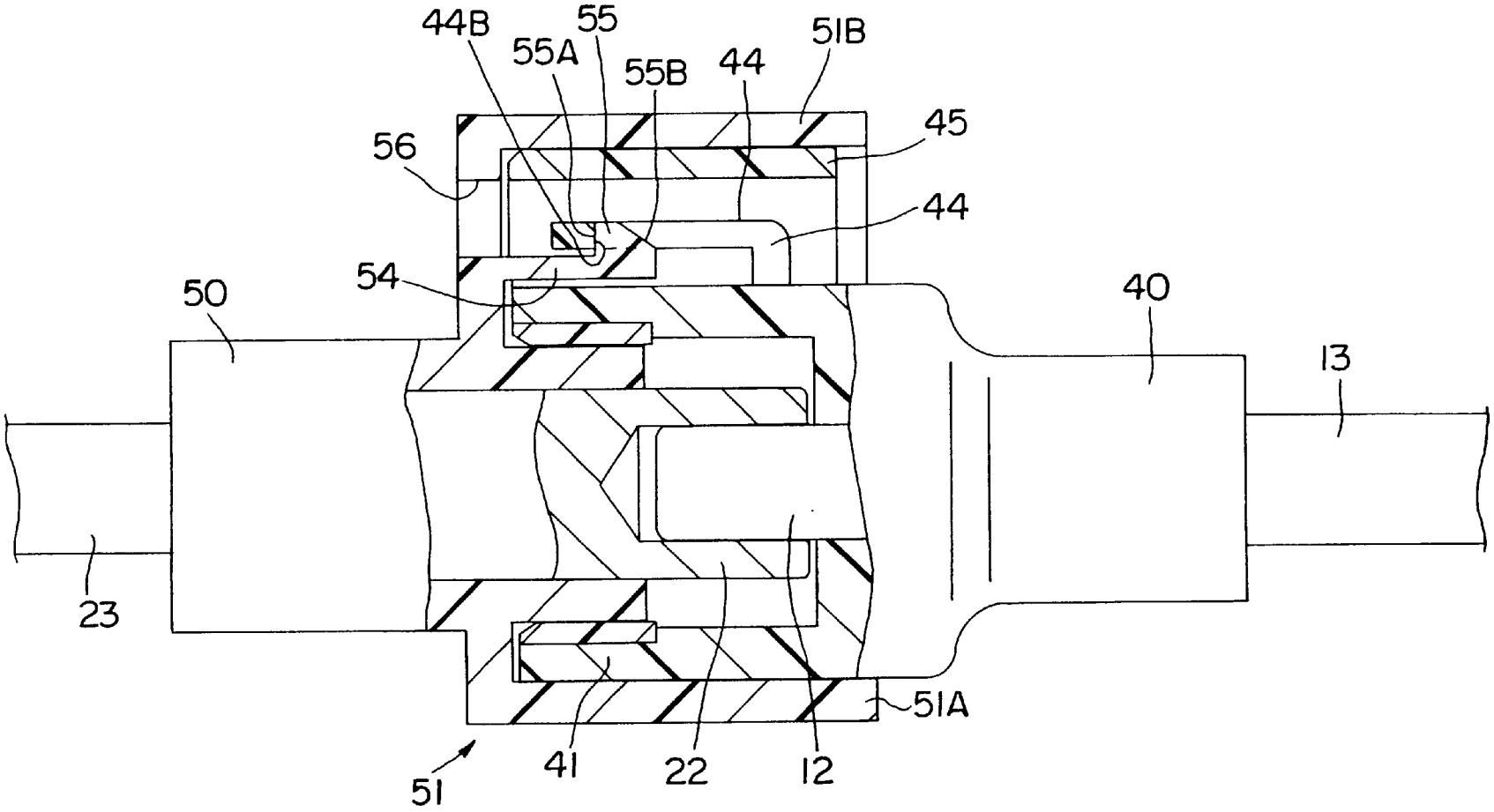
FIG. 5 is a section of the second embodiment when the connector housings are engaged to be locked with each other.
Figure 6:
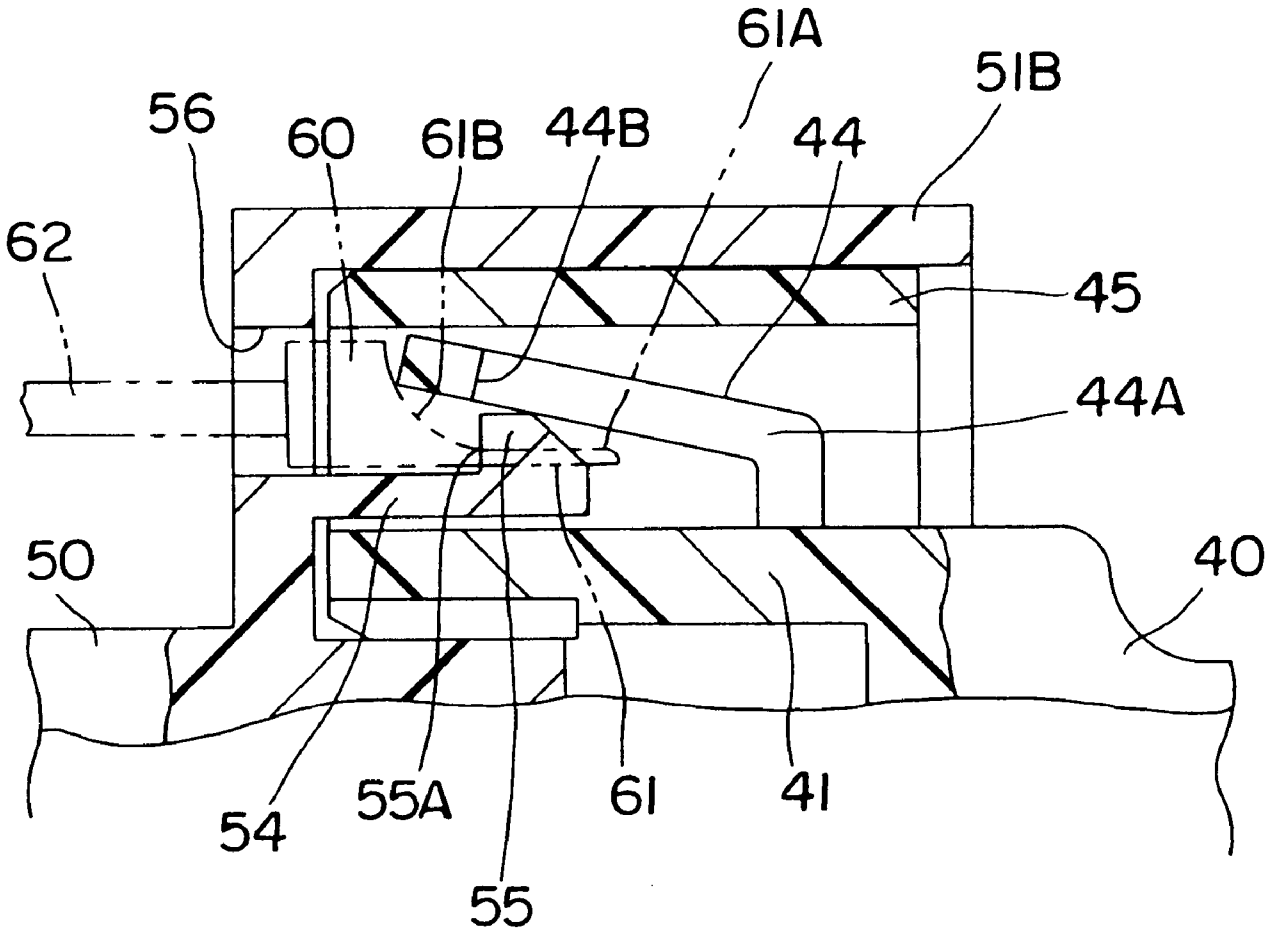
FIG. 6 is a partial section of the second embodiment in its unlocked state.

A second embodiment of the invention is described with reference to FIGS. 4 to 6. The locking means of this embodiment is different from that of the first embodiment. Since the other construction is the same as or similar to the first embodiment, no description is given on the structure, action and effects thereof by identifying it by the same reference numerals.

The locking means of the second embodiment is comprised of an elastic portion 44 formed on a male connector housing 40 and a lock projection 54 formed on a female connector housing 50.

The elastic portion 44 is formed on the outer surface of an engaging portion 41 and is shaped such that it extends upward from its fixed end at the rear end of the engaging portion 41 and is then bent so that its free end extends in a longitudinal direction, preferably toward the female connector housing 50, e.g. forwardly. A substantially middle part of the elastic portion 44 with respect to its width direction is e.g. cut away except the front end. The front end of this cut-away portion 44A acts as a lock surface 44B engageable with the lock projection 54. Further, on the outer surface of the engaging portion 41, a cover 45 for substantially covering the elastic portion 44 is integrally or unitarily formed. The cover 45 preferably has a substantially rectangular shape having open front and rear surfaces.

On the other hand, in the female connector housing 50, a hood or receptacle 51 is comprised of a semicircular portion 51A fittable around the engaging portion 41 and a substantially rectangular covering portion 51B fittable substantially around the cover 45. The lock projection 54 projects forwardly from the rear surface of the cover portion 51B, and a protuberance 55 is formed at the projecting end of the lock projection 54. The protuberance 55 includes a lock surface 55A that is engageable with the lock surface 44B of the elastic portion 44 and a slanted surface 55B which can push the leading end of the elastic portion 44 in a radial direction, preferably away from the male connector housing 40, e.g. upwardly. In the preferably rear wall of the covering portion 51B is formed a jig insertion hole 56 that is used to insert a jig 60 for an unlocking purpose. It should be noted that this jig insertion hole 56 also acts as a mold withdrawal hole formed when the protuberance 55 is formed.

The jig 60 is comprised of a pair of forwardly projecting displacing or deforming (preferably push-up) portions 61 and a backwardly projecting narrow grip 62. The leading end of each push-up portion 61 has its upper surface slanted to form a slip portion 61A, and the upper surface of the base portion of the deforming or push-up portion 61 is gradually thickened to form an arcuate surface, thereby forming a deforming or push-up surface 61B.

To engage the connector housings 40 and 50, the semicircular portion 51A and the covering portion 51B of the receptacle 51 are fitted substantially around the engaging portion 41 and the cover 45. The connector housings 40 and 50 then are pushed into each other while being positioned along a circumferential direction. Then, the lock projection 54 enters a clearance between the engaging portion 41 and the elastic portion 44, and the slanted surface 55B comes into contact with the leading edge of the elastic portion 44, preferably from below. Due to a pressing force of the slanted surface 55B, the elastic portion 44 is deformed elastically so as to move onto the protuberance 55. When the connector housings 40 and 50 are engaged properly, the elastic portion 44 is disengaged from the protuberance 55 and is restored elastically substantially to its original position. As a result, as shown in FIG. 5, the lock surface 55A of the protuberance 55 and the lock surface 44B of the elastic portion 44 are engaged to lock the connector housings 40 and 50 in their engaged state.

In this state, the engaged elastic portion 44 and protuberance 55 substantially are concealed by the cover 45 and the covering portion 51B. Since the insides of the cover 45 and the covering portion 51B are narrow, an operator cannot directly touch the elastic portion 44 with his hand or finger. Accordingly, it is impossible for the operator to unlock the connector housings 40, 50 by operating the elastic portion 44 with his hand or finger.

To unlock the connector housings 40 and 50, the jig 60 is inserted into the jig insertion hole 56 to cause the slip portions 61A to slip under the elastic portion 44, and then is inserted further. Then, the push-up surface 61B comes into contact with the lower edge of the leading end of the elastic portion 44, thereby pushing up the elastic portion 44 along its arcuate surface. As a result, the elastic portion 44 is disengaged from the protuberance 55 to unlock the connector housings 40, 50 as shown in FIG. 6. Thereafter, the connector housings 40, 50 are separated from each other in this state.

As described above, in this embodiment, the connector housings 40 and 50 are locked at once only by being engaged with each other, thereby improving operability. Further, since the connector housings 40 and 50 cannot be unlocked by hand or finger, an inadvertent disengagement thereof can be prevented securely.

Furthermore, the elastic portion 44 is covered by the cover 45 while the connector housings 40 and 50 are separated from each other. This prevents the elastic portion 44 from being disadvantageously deformed upon contact with another male connector housing 40 during the keeping and/or transportation.

Figure 7:
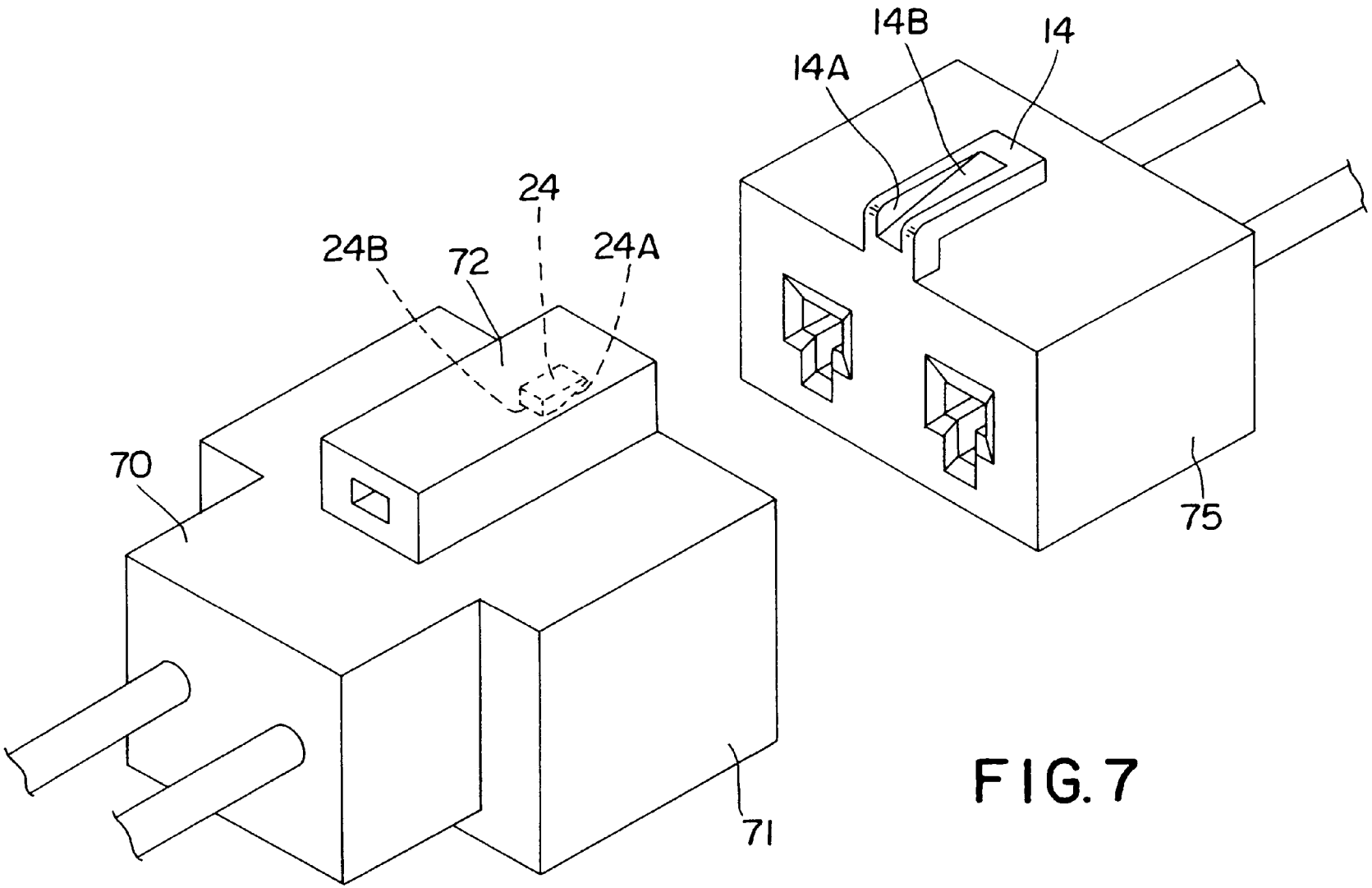
FIG. 7 is a perspective view of a third embodiment when both connector housings are separated from each other.

A third embodiment of the invention is described with reference to FIG. 7. The third embodiment differs from the first embodiment in the construction of the connector housings.

Although the connector according to the first embodiment is of one-contact type in which the male connector housing 10 and the female connector housing 20 are provided with the single male terminal fitting 12 and the signal female terminal fitting 22, respectively, the one according to the third embodiment is of two-contact type in which male and female connector housings are provided with two male terminal fittings (not shown) and two female terminal fittings (not shown), respectively. Further, a male connector housing 70 and a female connector housing 75 have a rectangular shape as a whole.

On the upper surface of the female connector housing 75, an elastic portion 14 having the same or similar construction as that of the first embodiment is integrally formed. On the other hand, a hood or receptacle 71 of the male connector housing 70 is provided with a covering portion 72 for accommodating the elastic portion 14, and a lock projection 24 having the same construction as that of the first embodiment is formed on the ceiling surface of the covering portion 72.

Since the other construction is same or similar as the first embodiment, no description is given on the structure, action and effects thereof by identifying it by the same reference numerals.

Figure 8:
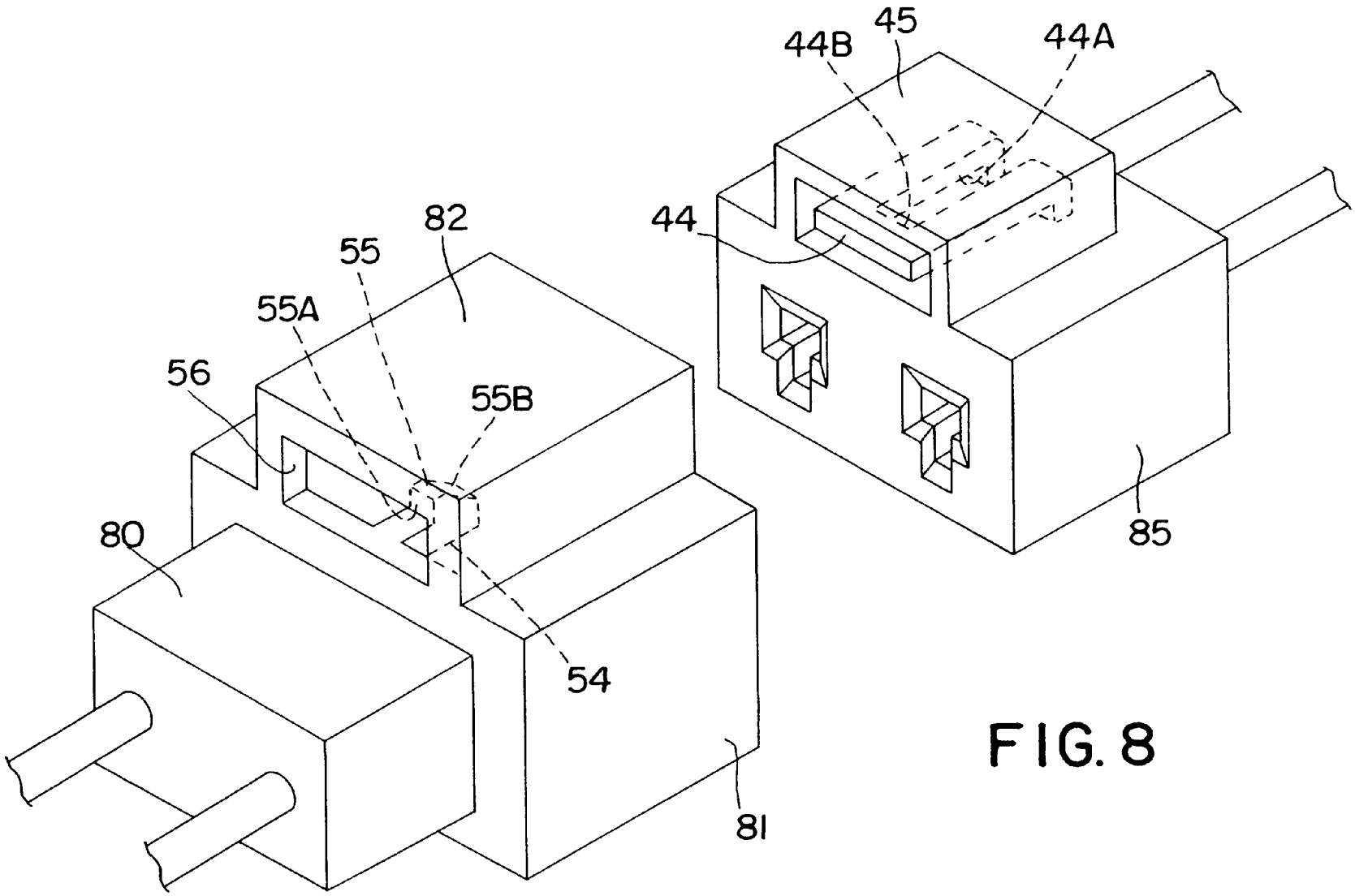
FIG. 8 is a perspective view of a fourth embodiment when both connector housings are separated from each other.

A fourth embodiment of the invention is described with reference to FIG. 8. The fourth embodiment differs from the second embodiment in the construction of the connector housings. Although the connector according to the second embodiment is of one-contact type in which the male connector housing 40 and the female connector housing 50 are provided with the single male terminal fitting 12 and the signal female terminal fitting 22, respectively, the one according to the fourth embodiment is of two-contact type in which male and female connector housings are provided with two male terminal fittings (not shown) and two female terminal fittings (not shown), respectively. Further, a male connector housing 80 and a female connector housing 85 have a rectangular shape as a whole.

On the upper surface of the female connector housing 85, an elastic portion 44 and a cover 45 having the same or similar construction as those of the second embodiment are integrally or unitarily formed. On the other hand, a hood or receptacle 81 of the male connector housing 80 is provided with a covering portion 82 engageable with the cover 45, and a lock projection 54 having the same or similar construction as that of the second embodiment is formed on the rear end surface of the covering portion 82.

Since the other construction is same or similar as the second embodiment, no description is given on the structure, action and effects thereof by identifying it by the same reference numerals.

Figure 9:
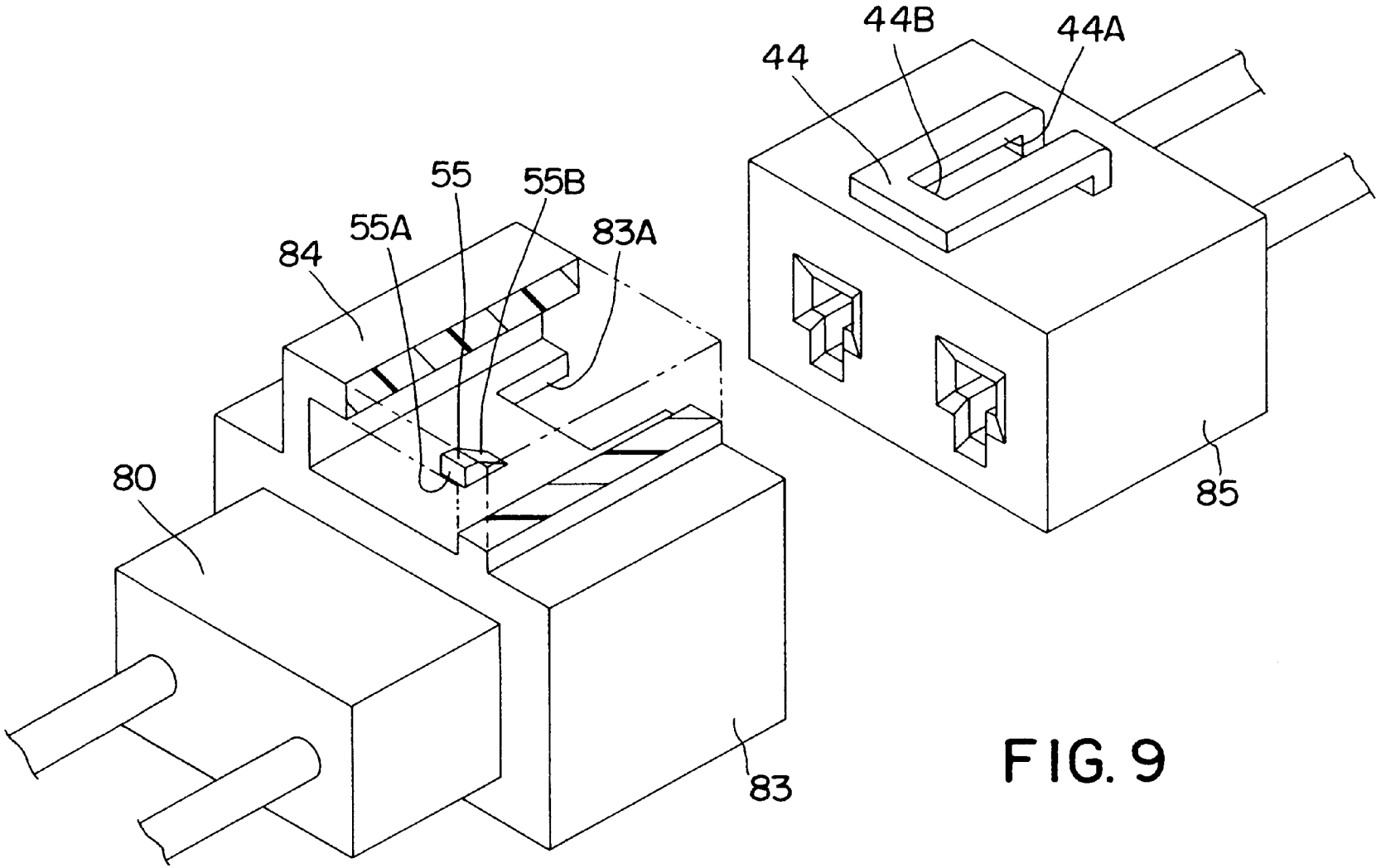
FIG. 9 is a perspective view partly in section of a fifth embodiment when both connector housings are separated from each other.
Figure 10:
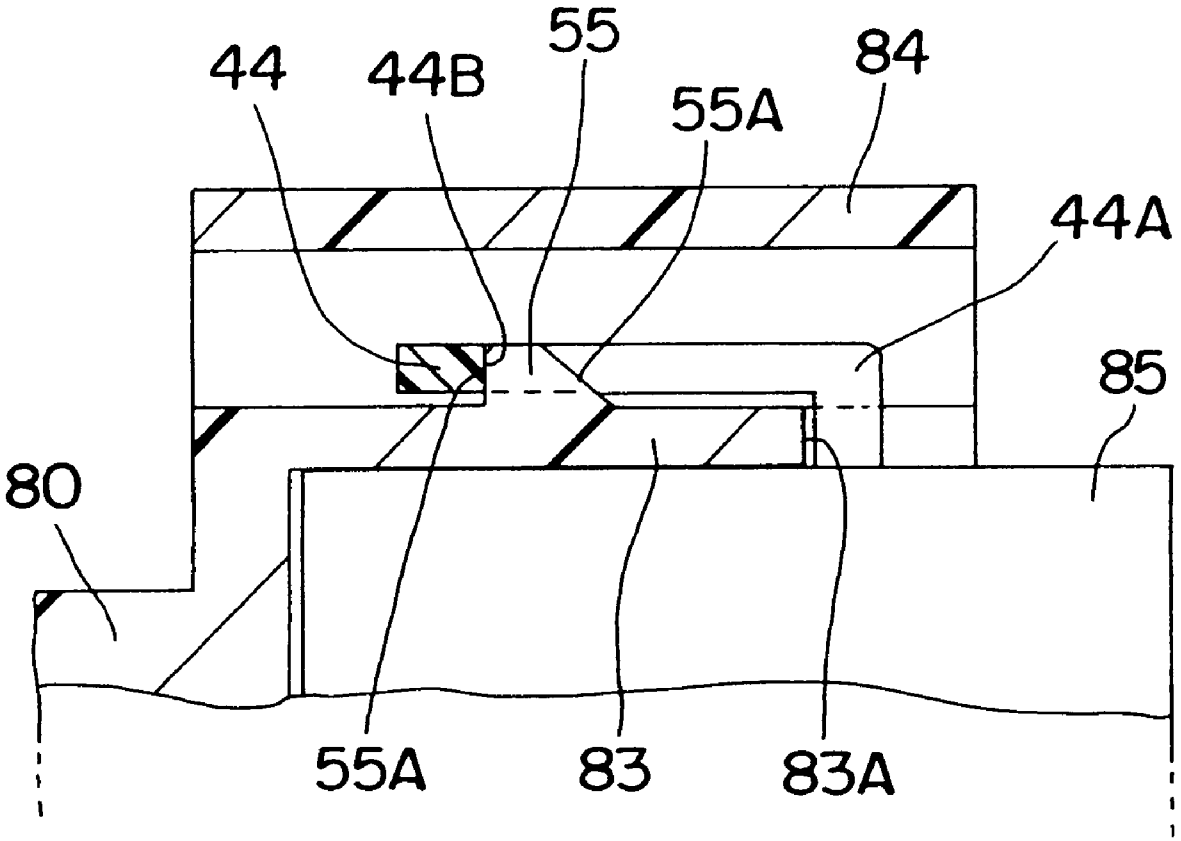
FIG. 10 is a section of the fifth embodiment when the connector housings are engaged to be locked with each other.
Figure 11:
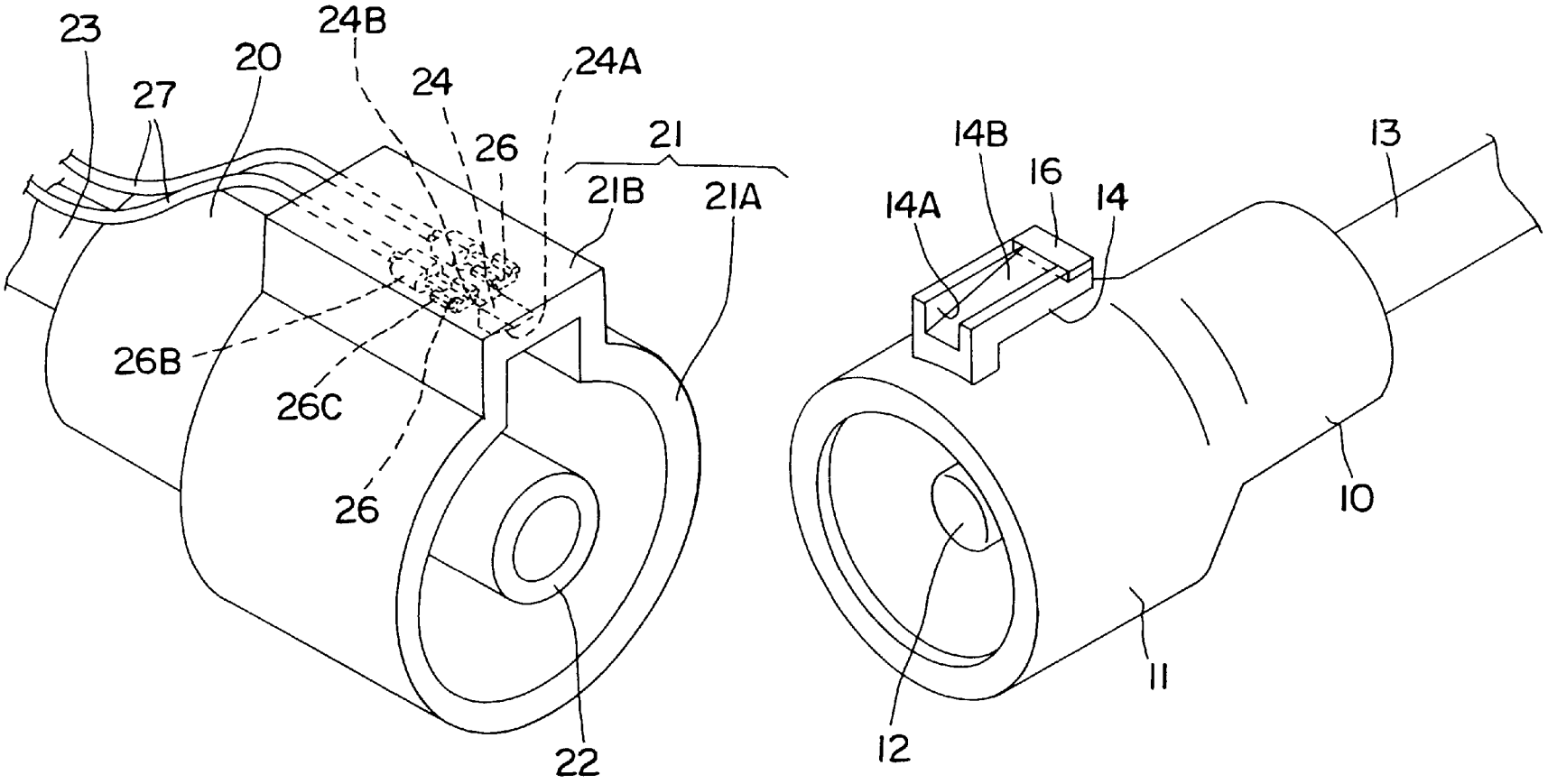
FIG. 11 is a perspective view partly in section of a sixth embodiment when both connector housings are separated from each other.

A fifth embodiment of the invention is described with reference to FIGS. 9 and 10. The fifth embodiment differs from the fourth embodiment in the construction of the locking means. Although the female connector housing 85 is provided with the cover 45 in the fourth embodiment, no cover 45 is provided in the fifth embodiment such that the elastic portion 44 is exposed. In the male connector housing 80, a hood or receptacle 83 has preferably such a substantially rectangular shape that only the female connector housing 85 can be fitted thereinto, and a covering portion 84 having open front and rear surfaces is formed on the upper surface. Inside the covering portion 84, a protuberance 55 projecting from the outer surface of the receptacle 83 is formed. This protuberance 55 has the same or similar construction as the protuberance 55 formed at the leading end of the lock projection 54 according to the fourth embodiment, and has a lock surface 55A and a slanted surface 55B. Further, a notch 83A is formed in the upper surface of the receptacle 83 in order to avoid the interference with the base end of the elastic portion 44.

Since the other construction is same or similar as the fourth embodiment, no description is given on the structure, action and effects thereof by identifying it by the same reference numerals.

A sixth embodiment of the invention is described with reference to FIGS. 11 to 14. The sixth embodiment differs from the first embodiment in the provision of the unlock detecting means. Since the other construction is same as or similar to the first embodiment, no description is given on the structure, action and effects thereof by identifying it by the same reference numerals.

The male and female side wires 13, 23 are, for example, connected with electric circuits (not shown) such as high voltage circuits for charging in an electric automotive vehicle. These electric circuits are connected with an unlock detecting means for detecting the unlocking e.g. by the jig 30 to cut off a power application to the electric circuits and a self-maintaining circuit (not shown) for maintaining an electrically shut off state once the power application is cut off.

The unlock detecting means is comprised of a switch element including a short-circuiting fitting 16 and a pair of detection fittings 26.

The short-circuiting fitting 16 is embedded in the leading end of the elastic portion 14 of the male connector housing 10 in such a manner that it is substantially flush with the upper surface of this leading end. The short-circuiting fitting 16 and the elastic portion 14 are made integral e.g. by insert molding.

The pair of detection fittings 26 are so mounted as to be substantially flush with the ceiling surface of the covering portion 21B preferably by substantially fitting the opposite ends thereof in mount grooves 28 formed there. Detection wires 27 connected with wire connection portions 26B of the respective detection fittings 26 are pulled out preferably through the mold withdrawal hole 25 to extend along the outer surface of the female connector housing 20 and along the wires 23 projecting from the rear end of the female connector housing 20, and are connected with the electric circuit. It is desirable to protect portions of the detection wires 27 exposed from the covering portion 21 by a cover or like means. Further, each detection fitting 26 is formed with a contact portion 26A projecting from the ceiling surface of the covering portion 21B.

The short-circuiting fitting 16 is located in the vicinity, preferably substantially above the detection fittings 26 when the elastic portion 14 and the lock projection 24 are locked. The contact portions 26A elastically touch the short-circuiting fitting 16 due to an elastic restoring force of the elastic portion 14, with the result that the detection fittings 26 are short-circuited by the short-circuiting fitting 16. In this short-circuited state, the switch element is on and the electric circuit is electrically on. When the short-circuiting of the detection fittings 26 is released by the unlocking by means of the jig 30, the switch element is turned off and the unlock detecting means detects the unlocking by the jig 30 to shut off the electric circuit.

Figure 12:
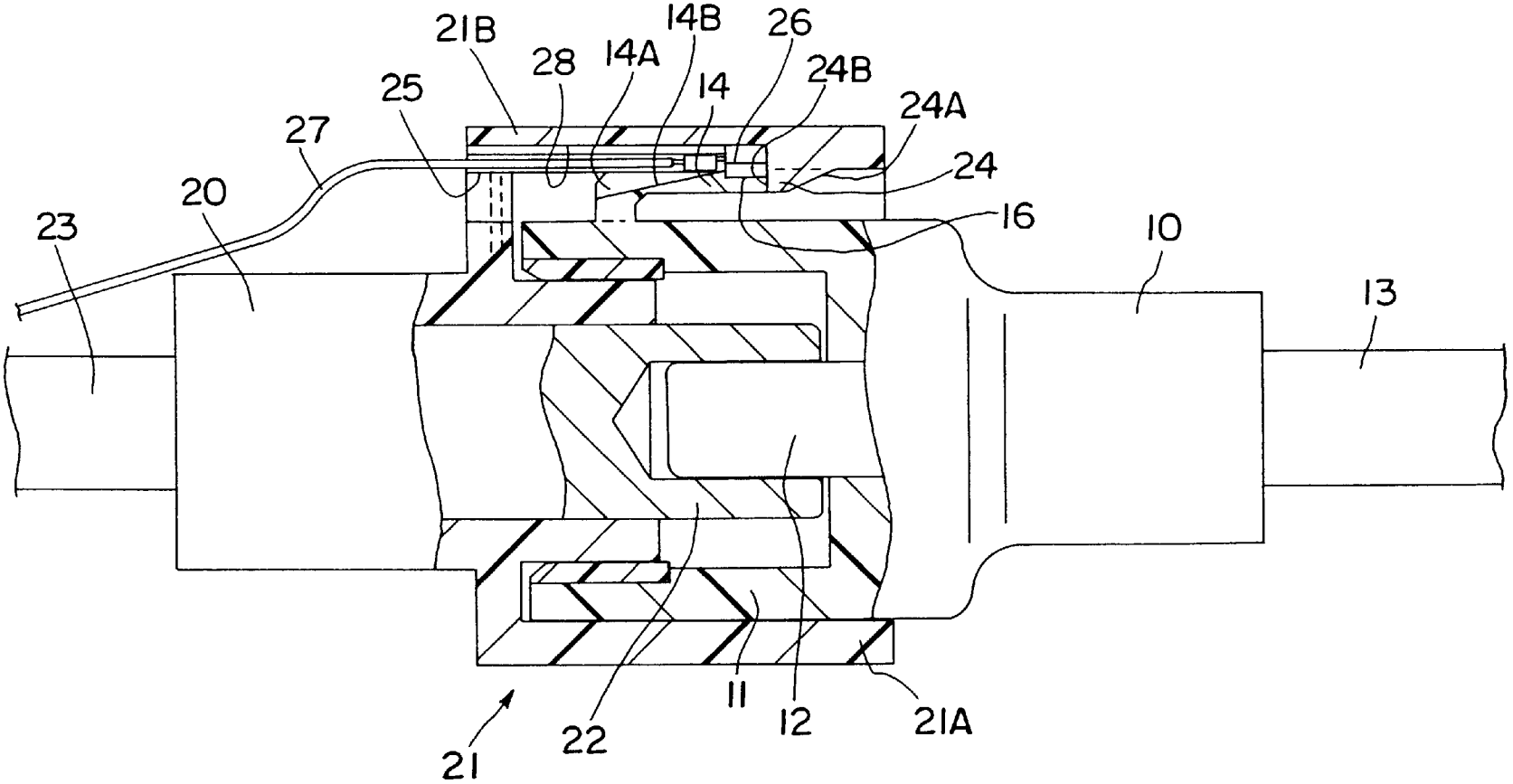
FIG. 12 is a section of the sixth embodiment when the connector housings are engaged to be locked with each other.

To engage the connector housings 10 and 20, the receptacle 21 is fitted around the engaging portion 11, and the connector housings 10 and 20 are pressed into each other while being positioned with respect to circumferential direction by a positioning means (not shown) constructed by, e.g. a projection and a groove. Then, the lock projection 24 enters the jig insertion portion 14A and comes into contact with the slanted surface 14B. Due to a pressing force acting on the slanted surface 14B, the elastic portion 14 undergoes such an elastic deformation as to move away from the lock projection 24. When the connector housings 10 and 20 are properly engaged, the lock projection 24 is disengaged from the upper surface of the elastic portion 14, which then is restored elastically to its original position. As a result, as shown in FIG. 12, the lock surface 24B of the lock projection 24 and the leading end surface of the elastic portion 14 are locked. The connector housings 10 and 20 are locked in their engaged state by the engagement of the lock projection 24 and the elastic portion 14.

In this state, the engaged elastic portion 14 and lock projection 24 are concealed by the covering portion 21B. Since the inside of the covering portion 21B is narrow, an operator cannot touch the elastic portion 14 directly with his hand or finger. Accordingly, it is impossible for the operator to unlock the connector housings 10 and 20 by operating the elastic portion 14 with his hand or finger.

In this locked state, the electric circuit is electrically on since the short-circuiting fitting 16 is short-circuiting the detection fittings 26.

Figure 13:
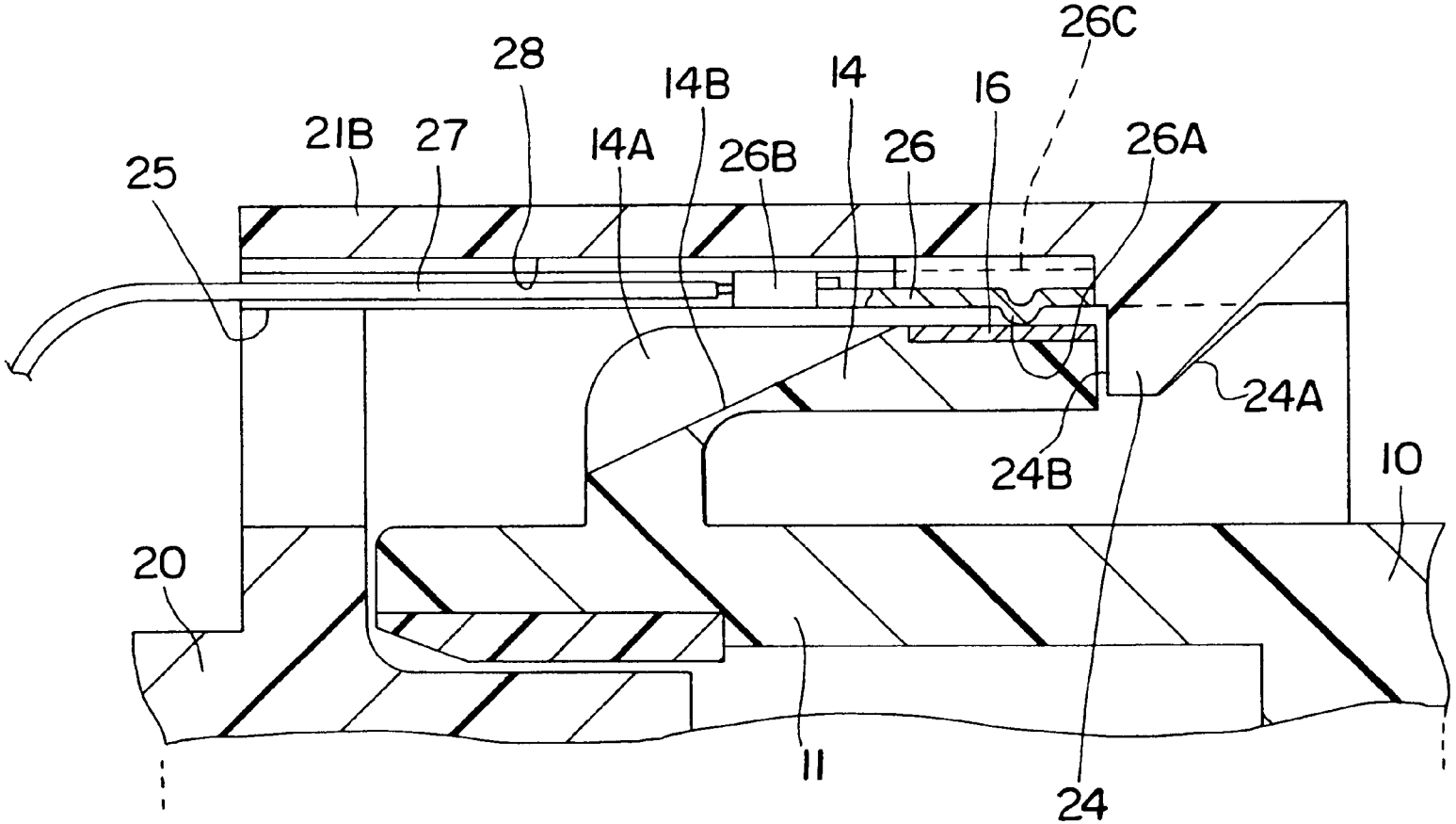
FIG. 13 is a partial enlarged section of the sixth embodiment when the connector housings are engaged to be locked with each other.
Figure 14:
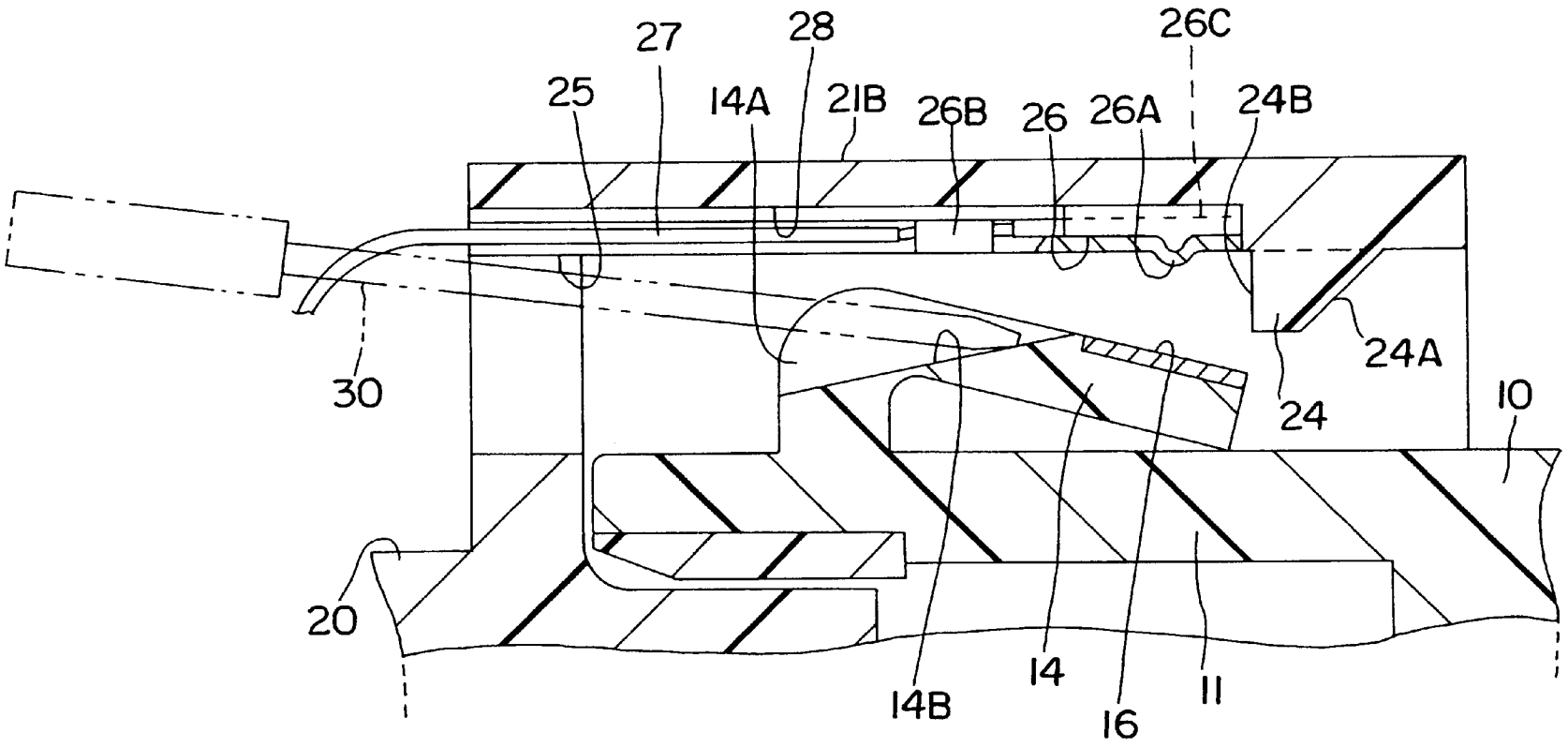
FIG. 14 is a partial enlarged section of the sixth embodiment when the connector housings are unlocked.
Figure 15:
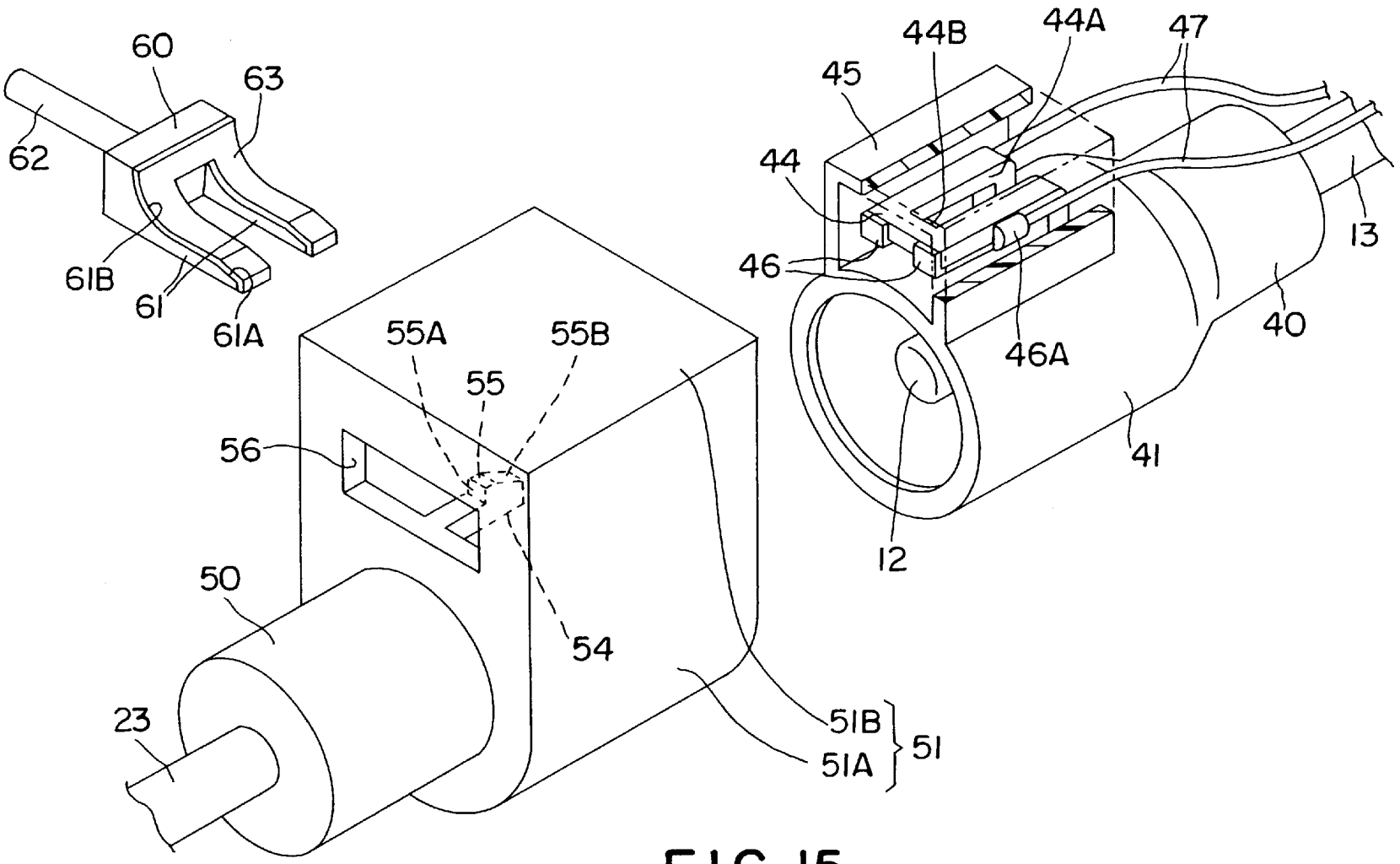
FIG. 15 is a perspective view partly in section of a seventh embodiment when both connector housings are separated from each other.
Figure 16:
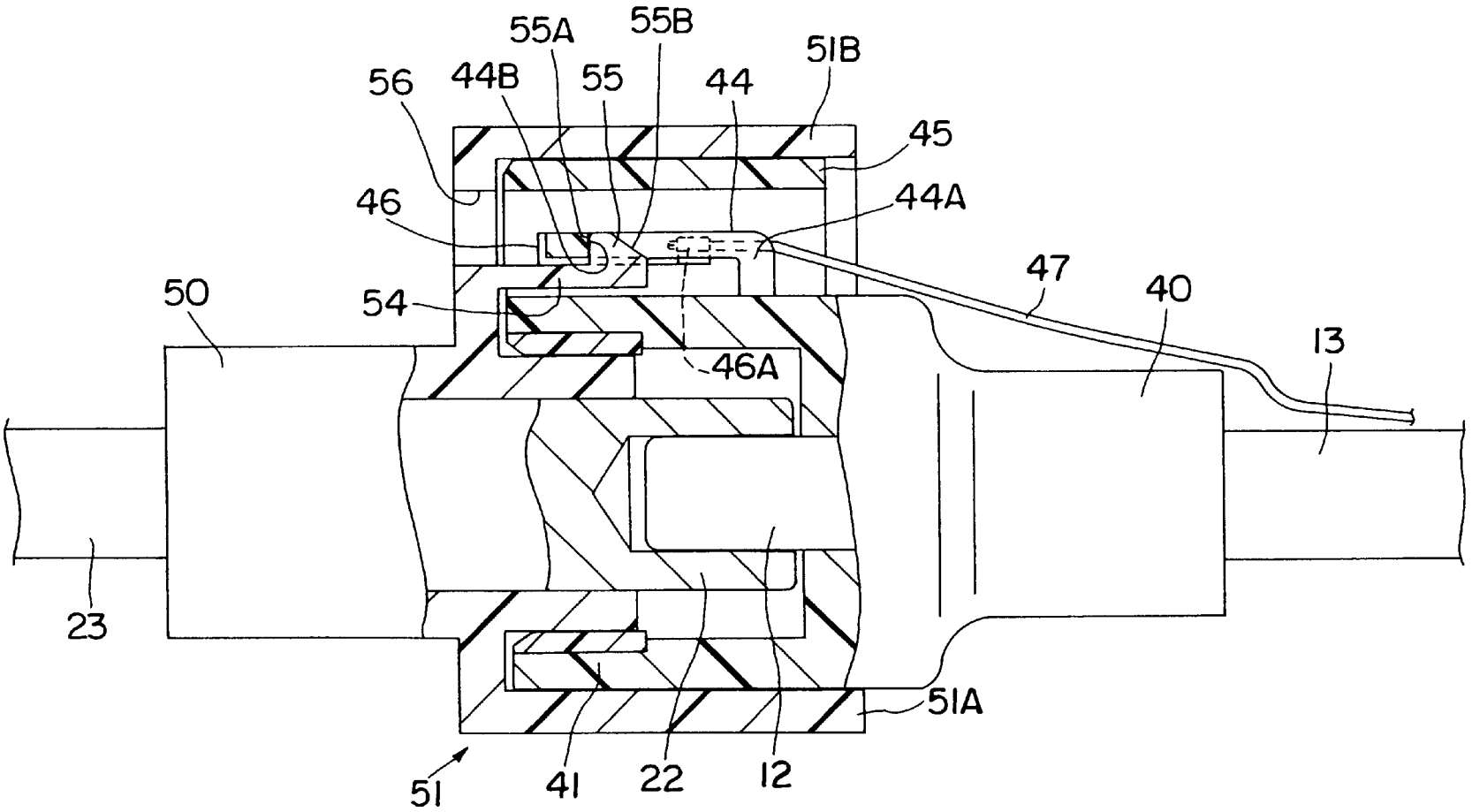
FIG. 16 is a section of the seventh embodiment when the connector housings are engaged to be locked with each other.

To unlock the connector housings 10 and 20, the jig 30 is inserted through the mold withdrawal hole 25 to come into contact with the slanted surface 14B of the jig insertion portion 14A, and is operated to lower the jig insertion portion 14A. Then, as shown in FIG. 13, the elastic portion 14 is deformed away from the lock projection 24 to unlock the connector housings 10 and 20.

Accordingly, the short-circuiting fitting 16 moves away from the detection fittings 26 to release the short-circuited state thereof, and the switch element is turned off. Thereupon, the unlocking by the jig 30 is detected and the electric circuit is electrically shut off.

Thereafter, if the connector housings 10 and 20 are slightly moved away from each other in the unlocked state by the jig 30, the lock projection 24 comes into contact with the upper surface of the elastic portion 14. Thereafter, the jig 30 is withdrawn and the connector housings 10 and 20 are separated from each other.

As described above, in this embodiment, the connector housings 10 and 20 are locked at once only by being engaged with each other, thereby improving operability. Further, since the connector housings 10 and 20 cannot be unlocked by hand or finger, an inadvertent disengagement thereof can be prevented securely. Further, the unlocking by the jig 30 is detected to electrically shut off the electric circuit. Thus, there is no likelihood that an arc is generated while the male and female terminal fittings 12 and 22 are separated.

Further, in this embodiment, since the unlocking is performed by the jig 30 taking advantage of the mold withdrawal hole 25 which is formed when the lock projection 24 is formed, the strength of the covering portion 21B is higher as compared to a case where a jig insertion hole- separate from the mold withdrawal hole 25 is formed, e.g. in the upper surface of the covering portion 21B.

Furthermore, since the elastic portion 14 is formed with the cut-away portion (jig insertion portion 14A) and the lock projection 24 is formed with the slanted surface 24A, an excessive deformation of the elastic portion 14 can be prevented while the connector housings 10 and 20 are being engaged and disengaged.

A seventh embodiment of the invention is described with reference to FIGS. 15 to 19. The seventh embodiment differs from the sixth embodiment in the construction of the locking means and the unlock detecting means. The seventh embodiment differs from the second embodiment in the provision of the unlock detecting means. Since the other construction is same or similar as the second embodiment, no description is given on the structure, action and effects thereof by identifying it by the same reference numerals.

The unlock detecting means is comprised of a switch element including a pair of detection fittings 46 provided on the elastic portion 44 and a short-circuiting fitting 63 provided on the jig 60.

The detection fittings 46, which are formed e.g. by bending the leading ends of plate members upwardly, extend substantially along the lower surface and the front end surface of the elastic portion 44 and the corner portions between these surfaces and are spaced apart to be positioned on the opposite sides of the cut-away portion 44A. A wire connecting portion 46A of each detection fitting 46 is formed to stand upright outside the elastic portion 44. Detection wires 47 connected with the wire connecting portions 46A are pulled out through an opening formed in a rear part of the cover 45, and preferably are arranged to extend substantially along the outer surface of the male connector housing 40 and along the wire 13 projecting from the rear end of the male connector housing 40, and are connected with an electric circuit (not shown). It is desirable to protect portions of the detection wires 47 exposed from the covering portion 51B by a cover or like means.

On the other hand, the short-circuiting fitting 63 is preferably a plate having a substantially forked leading end and is mounted along the upper surface of the deforming or push-up portion 61 of the jig 60. When the unlocking is performed by causing the jig 60 to slip substantially under the elastic portion 44, the short-circuiting fitting 63 comes into contact with both detection fittings 46 to short-circuit them.

The switch element is off when the detection fittings 46 are in their nonconductive state. When the unlocking by the jig 60 is performed to short-circuit the detection fittings 46, the switch element is turned on and the unlocked state is detected. Thus the electric circuit is electrically shut off.

Figure 17:
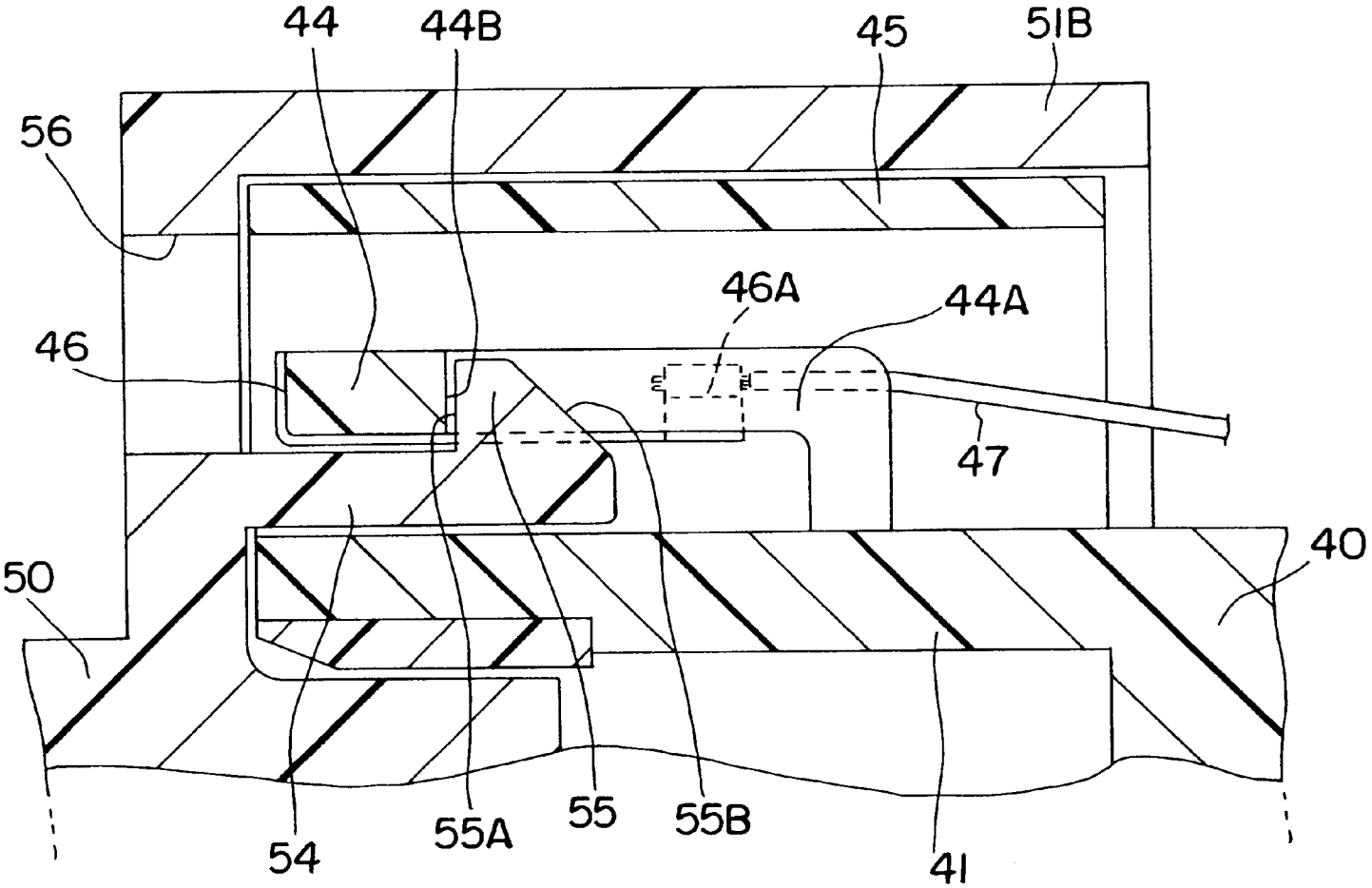
FIG. 17 is a partial enlarged section of the seventh embodiment when the connector housings are engaged to be locked.

To engage the connector housings 40 and 50, the semicircular portion 51A and the covering portion 51B of the receptacle 51 are fitted around the engaging portion 41 and the cover 45, and the connector housings 40 and 50 are pushed into each other while being positioned along a circumferential direction. Then, the lock projection 54 enters a clearance between the engaging portion 41 and the elastic portion 44, and the slanted surface 55B comes into contact with the leading edge of the elastic portion 44 from below. Due to a pressing force of the slanted surface 55B, the elastic portion 44 is deformed elastically so as to move onto the protuberance 55. When the connector housings 40 and 50 are properly engaged, the elastic portion 44 is disengaged from the protuberance 55 and is restored elastically to its original position. As a result, the lock surface 55A of the protuberance 55 and the lock surface 44B of the elastic portion 44 are engaged to lock the connector housings 40 and 50 in their engaged state, as shown in FIG. 17.

In this state, the engaged elastic portion 44 and protuberance 55 are concealed by the cover 45 and the covering portion 51B. Since the inside of the cover 45 and the covering portion 51B is narrow, an operator cannot directly touch the elastic portion 44 with his hand or finger. Accordingly, it is impossible for the operator to unlock the connector housings 40, 50 by operating the elastic portion 44 with his hand or finger.

Figure 18:
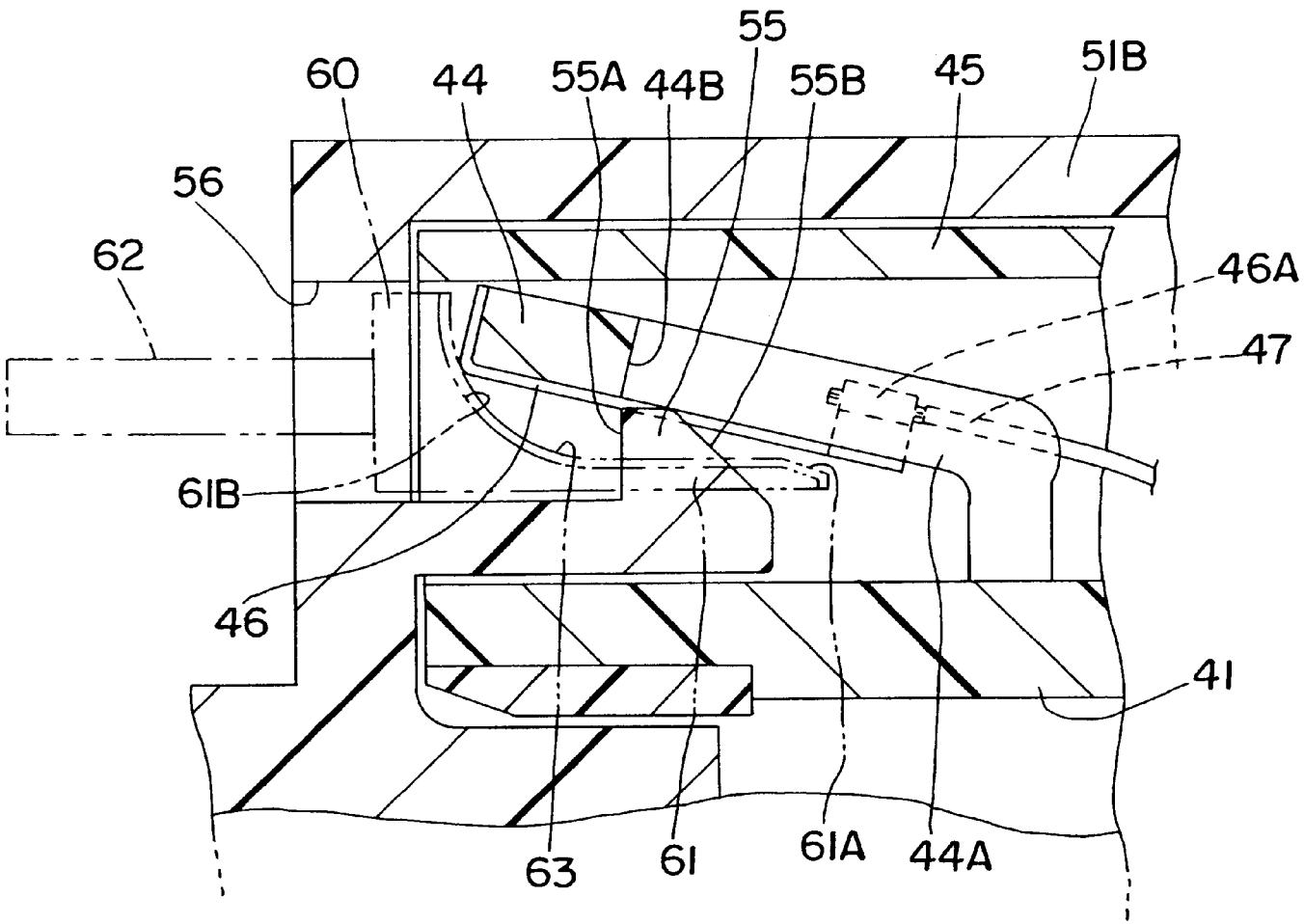
FIG. 18 is a partial enlarged section of the seventh embodiment when the connector housings are unlocked.
Figure 19:
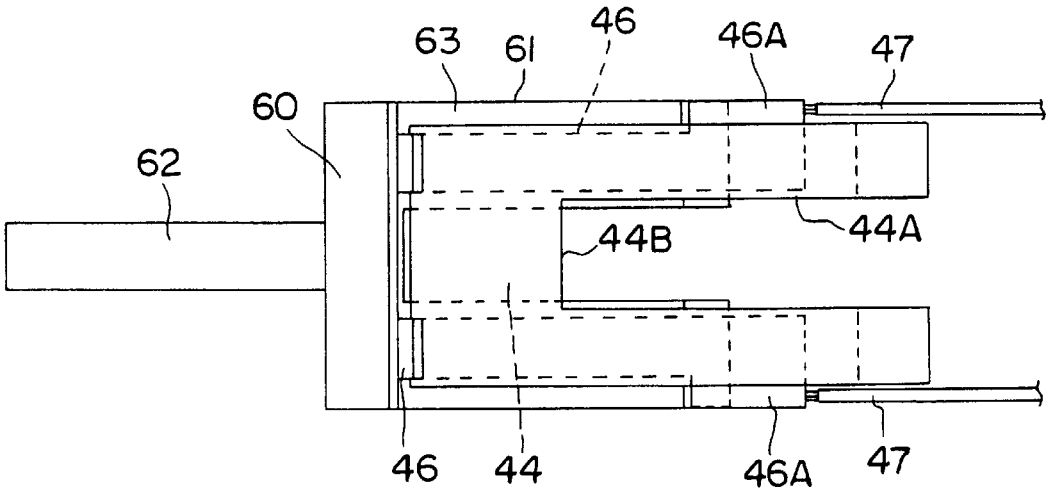
FIG. 19 is a partial enlarged plan view of the seventh embodiment when the connector housings are unlocked.
Figure 20:
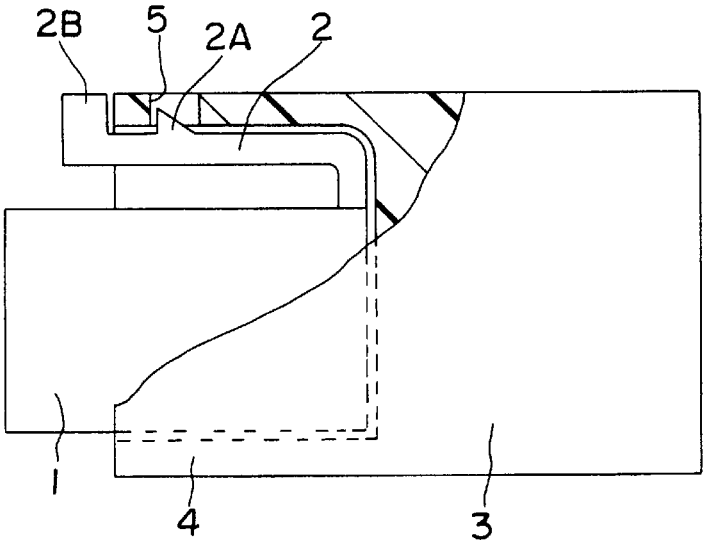
FIG. 20 PRIOR ART
FIG. 20 is a side view partly in section of a prior art connector in its engaged state.

To unlock the connector housings 40 and 50, the jig 60 is inserted into the jig insertion hole 56 to cause the slip portions 61A to slip under the elastic portion 44, and then is inserted further. The short-circuiting fitting 63 then comes into contact with the lower edges of the leading ends of a pair of detection fittings 46 mounted on the elastic portion 44, thereby pushing up the elastic portion 44 along its arcuate surface 61B. As a result, the elastic portion 44 is disengaged from the protuberance 55 to unlock the connector housings 40 and 50, as shown in FIG. 18.

When the unlocking is performed by the jig 60, the short-circuiting fitting 63 short-circuits the detection fittings 46, thereby turning the switch element on. As a result, the unlocking by the jig 60 is detected and the electric circuit is electrically shut off.

Thereafter, if the connector housings 40 and 50 are pulled slightly away from each other in the unlocked state by the jig 60, the leading end of the elastic portion 44 moves over the protuberance 55. Accordingly, the connector housings 40 and 50 are separated from each other by withdrawing the jig 60.

As described above, in this embodiment, the connector housings 40 and 50 are locked at once only by being engaged with each other, improving operability. Further, since the connector housings 40 and 50 cannot be unlocked by hand or finger, an inadvertent disengagement thereof can be prevented securely. Further, since the electric circuit is shut off electrically upon detecting the unlocking by the jig 60, there is no likelihood that a discharge phenomenon occurs while the male and female terminal fittings 12 and 22 are separated from each other.

Furthermore, the elastic portion 44 is covered by the cover 45 while the connector housings 40 and 50 are separated from each other. This prevents the elastic portion 44 from being disadvantageously deformed upon contact with an other male connector housing 40 during the keeping and/or transportation.

The present invention is not limited to the described and illustrated embodiments. For example, the following embodiments are also embraced by the technical scope of the present invention as defined in the claims. Besides the following embodiments, a variety of changes can be made without departing from the spirit and scope of the present invention as defined in the claims.

Although the number of contacts of the terminal fittings is one or two in the foregoing embodiments, the invention is also applicable when there are three or more contacts.

In the respective foregoing embodiments, the elastically deformable elastic portion and the nonelastic lock portion may be provided on the male connector housing and the female connector housings, respectively.

Although the unlocking by the jig is performed taking advantage of the mold withdrawal hole in the foregoing embodiments, a special jig insertion hole separate from the mold withdrawal hole may be formed in the upper surface of the covering portion or the upper surface of the cover according to the invention, which jig insertion hole allows to reach the elastic portion so as to deflect it away from the lock projection.

In the foregoing embodiments, the locking means is arranged inside the cover formed on the outer surface of the connector housing or inside the receptacle into which the mating connector housing is fittable in order to locate the locking means in such a position that it cannot be directly unlocked by hand or finger. However, according to the invention, the locking means may be concealed by a member other than the cover and the receptacle shown in the foregoing embodiments or may be accommodated in the connector housing.

Although the number of contacts of the terminal fittings is one in the foregoing embodiments, the invention is also applicable to connectors having two or more contacts.

Although the connector housings is circular in the foregoing embodiments, the invention is also applicable to rectangular connectors.

In the foregoing embodiments, an electrical detecting method is adopted according to which the switch element including the detection fittings and the short-circuiting fitting is used as the unlock detecting means for detecting the unlocking by the jig. However, according to the invention, not only electrical detecting method, but also other detecting methods may be adopted. An other detecting method may be, for example, such that a light emitting device and a photoelectric device are arranged to face each other in the mold withdrawal hole or jig insertion hole. The unlocking is detected when a light path between these devices is blocked by the jig.

In such a case, not only the unlocking by the jig, but also the entry of a foreign matter into a locking area can be detected. Thus, a likelihood of unlocking by the foreign matter can be detected and the electric circuit can be electrically shut off.

In the foregoing embodiments, the unlocking of the housings is detected by the interruption of a short circuit. However, it may be detected by the formation of a short-circuit, i.e. by short circuiting the detection wires.

What is claimed is:

1. A connector assembly comprising:

a first connector having a housing with an open front end defining at least one receptacle extending into the open front end, at least one terminal fitting being mounted in the receptacle and projecting toward the open front end, a lock projection disposed on said housing, a hood substantially surrounding said lock projection, said hood including open front and rear ends substantially aligned with the lock projection; and a second connector having a housing with an open front end, at least one terminal fitting mounted in the housing of the second connector and projecting toward the open front end thereof, the terminal fitting and the housing of the second connector being mateable respectively with the terminal fitting and the housing of the first connector, the second connector further having an elastic portion formed on said housing of said second connector and projecting toward the front end thereof, said elastic portion being configured for locking engagement with the lock projection of the first connector when the first and second connectors are mated, the second connector further comprising a hood formed on the housing of the second connector and substantially surrounding the elastic portion thereof, the hood being open at the front end of the housing of the second connector, the hood of the second connector and the hood of the first connector being dimensioned and configured for nested engagement with one another when the first and second connectors are mated, whereby the open rear end of the hood of the first connector enables access to the elastic portion of the second connector for disengaging the elastic portion from the lock projection and enabling unlocking of the connectors.

2. The connector assembly of claim 1, wherein the at least one terminal fitting of the first and second connectors includes a plurality of terminal fittings such that the terminal fittings of the first connector are mateable with the terminal fittings of the second connector.

3. A connector assembly according to claim 1, further comprising an unlock detecting means for electrically shutting off electric circuits by detecting the unlocking of the connector housings.

4. A connector assembly according to claim 3, wherein the unlock detecting means comprises a switch element including at least one pair of detection fittings provided on the elastic portion of at least one connector housing (10, 20) and at least one short-circuiting fitting provided on the locking means of the other connector housing, the pair of detection fittings being short-circuited by the short-circuiting fitting in a locked state, and wherein the short-circuiting of the pair of detection fittings is released by the unlocking by the auxiliary tool.

5. A connector assembly according to claim 3, wherein the elastic portion is unlockable only by the operation of an auxiliary tool and the unlock detecting means electrically shuts off the electric circuits by detecting the unlocking by the auxiliary tool.

6. A connector assembly according to claim 5, wherein the unlock detecting means comprises a switch element including at least one pair of detection fittings provided on the elastic portion and at least one short-circuiting fitting for short-circuiting the pair of detection fittings upon the unlocking of the connector housings.

7. A connector assembly according to claim 6, wherein the at least one short-circuiting fitting is provided on the auxiliary tool for short-circuiting the pair of detection fittings upon the unlocking by the auxiliary tool .

8. The connector assembly of claim 1, wherein the elastic portion of the second connector includes first and second substantially parallel deflectable beams projecting outwardly and forwardly on the housing of the second connector and a lock surface extending between the beams, the lock projection including a protuberance extending therefrom for locked engagement by the lock surface of the elastic portion of the second connector.

9. The connector assembly of claim 8, further comprising a jig dimensioned for insertion through the hole in the rear end of the hood of the first connector for engagement with the elastic portion of the second connector to selectively disengage the elastic member of the second connector from the lock projection of the first connector.

10. The connector assembly of claim 9, wherein at least one of the elastic portion and the jig is formed with a cam surface such that linear movement of the jig through the hole in the rear end of the hood of the first connector generates deflection of the elastic portion without pivoting movement with the jig.

11. A connector assembly comprising:

a first connector having a housing with an open front end, a rear end and sidewalls extending therebetween to define at least one receptacle extending into the open front end, at least one terminal being mounted in the receptacle and projecting toward the open front end, a lock projection being formed on one of said sidewalls and projecting into the receptacle, the rear end of the housing having a hole extending therethrough and into the receptacle at a location substantially aligned with the lock projection; and a second connector having a housing with an open front end, a rear end and sidewalls extending therebetween, at least one terminal fitting mounted in the housing of the second connector and projecting toward the open front end thereof, the terminal fitting and the housing of the second connector being mateable respectively with the terminal fitting and the housing of the first connector, the second connector further having an elastic portion formed at an exterior position on the sidewall of the housing of the second connector and projecting toward the rear end thereof, said elastic portion being configured for locking engagement with the lock projection in the receptacle of the first connector when the first and second connectors are mated, whereby the hole in the rear end of the housing of the first connector enables access to the elastic portion of the second connector for disengaging the elastic portion from the lock projection and enabling unlocking of the connectors.

12. The connector assembly of claim 11, wherein the elastic portion of the second connector includes a slanted surface facing the front end of the second connector and aligned for engagement with the lock projection of the first connector, the slanted surface generating deflection of the elastic portion during mating, the elastic portion further having a lock surface facing the rear end of the second connector, the lock surface being disposed for locked engagement with the lock projection of the first connector when the connectors are fully mated.

13. The connector assembly of claim 12, wherein the elastic portion of the second connector further includes a pair of beams disposed on opposite respective sides of the slanted surface and spaced from one another sufficiently for receiving the lock projection of the first connector therebetween, the slanted surface being accessible from the hole in the housing of the first connector for deflecting said elastic portion to enable unlocking of the connectors.

14. A connector assembly according to claim 11, further comprising an unlock detecting means for electrically shutting off electric circuits by detecting the unlocking of the connector housings.

15. A connector according to claim 14, wherein the unlock detecting means comprises a switch element including at least one pair of detection fittings provided on the locking means of at least one connector housing and at least one short-circuiting fitting provided on the locking means of the other connector housing, the pair of detection fittings being short-circuited by the short-circuiting fitting in a locked state, and wherein the short-circuiting of the pair of detection fittings is released by the unlocking by the auxiliary tool.

16. A connector assembly according to claim 14, wherein the locking means is unlockable only by the operation of an auxiliary tool and the unlock detecting means electrically shuts off the electric circuits by detecting the unlocking by the auxiliary tool.

17. A connector assembly according to claim 16, wherein the unlock detecting means comprises a switch element including at least one pair of detection fittings provided on the locking means and at least one short-circuiting fitting for short-circuiting the pair of detection fittings upon the unlocking of the connector housings.

* * * * *